US006520895B2

(12) United States Patent
Senga et al.

(10) Patent No.: US 6,520,895 B2
(45) Date of Patent: Feb. 18, 2003

(54) POLISHING DEVICE AND POLISHING PAD COMPONENT EXCHANGE DEVICE AND METHOD

(75) Inventors: Tatsuya Senga, Kawasaki (JP); Kazuo Kobayashi, Kanagawa-ken (JP); Satoru Ide, Kanagawa-ken (JP); Kiyoshi Tanaka, Machida (JP)

(73) Assignee: Nikon Corporation, Tokyo (JP)

( * ) Notice: Subject to any disclaimer, the term of this patent is extended or adjusted under 35 U.S.C. 154(b) by 0 days.

(21) Appl. No.: 09/799,632

(22) Filed: Mar. 7, 2001

(65) Prior Publication Data

US 2001/0041650 A1 Nov. 15, 2001

Related U.S. Application Data

(63) Continuation-in-part of application No. 09/539,889, filed on Mar. 31, 2000, now abandoned.

(30) Foreign Application Priority Data

Sep. 5, 2000 (JP) ..... 2000-268004

(51) Int. Cl.[7] ..... B23Q 3/157

(52) U.S. Cl. ..... 483/1; 451/342; 483/31; 483/33; 483/36; 483/38

(58) Field of Search ..... 483/1, 30, 31, 483/32, 33, 36, 51, 49, 53, 57; 451/342

(56) References Cited

U.S. PATENT DOCUMENTS

| | | | | |
|---|---|---|---|---|
| 4,485,595 | A | * 12/1984 | Minamiyama et al. | 483/30 |
| 4,551,902 | A | * 11/1985 | Thibaut | 451/342 |
| 4,712,289 | A | * 12/1987 | Stamm et al. | 451/342 |
| 5,277,688 | A | * 1/1994 | Whittington et al. | 483/33 |
| 5,377,455 | A | * 1/1995 | Lanzer | 451/5 |
| 5,478,271 | A | * 12/1995 | Thibaut | 483/54 X |
| 5,743,965 | A | * 4/1998 | Nishimura et al. | 118/319 |
| 6,247,999 | B1 | * 6/2001 | Tokiwa | 451/57 |
| 6,296,555 | B1 | * 10/2001 | Inaba et al. | 451/282 |
| 6,343,975 | B1 | * 2/2002 | Mok | 451/285 |

* cited by examiner

*Primary Examiner*—William Briggs
(74) *Attorney, Agent, or Firm*—Oblon, Spivak, McClelland, Maier & Neustadt, P.C.

(57) ABSTRACT

A polishing device includes a wafer chuck mechanism which retains a wafer while its plane to be polished faces upward, a polishing pad component which possesses a polishing plane which polishes the wafer, a polishing head, and a shift mechanism which enables a relative displacement of said polishing pad component in relation to the wafer. A fixation and retention mechanism fixes and retains said polishing pad component to the polishing head in a detachable fashion while its polishing plane faces downward. The displacement distance of the shift mechanism ranges from the polishing position of the wafer to the exchange position of the polishing pad component, so that the polishing pad component is automatically exchanged.

20 Claims, 13 Drawing Sheets

POLISHING DEVICE AND POLISHING PAD COMPONENT EXCHANGE DEVICE AND METHOD

CROSS REFERENCE TO RELATED APPLICATIONS

The present application is a continuation-in-part of U.S. patent application Ser. No. 09/539,889, filed on Mar. 31, 2000, abandoned.

BACKGROUND OF THE INVENTION

1. Field of the Invention

The present invention concerns a semiconductor flattening and polishing device which can be applied to processes for manufacturing semiconductor devices such as ultra-high-density integrated circuits (ULSIs), and more specifically, it concerns a protocol for exchanging polishing pad components in such a flattening and polishing operation.

2. Description of the Background

There are known polishing devices wherein wafers are polished or CMP-polished by using a polishing pad component which is axially supported on a spindle axle and by pressing a wafer which is retained by a chuck from above while a polishing material slurry is fed onto its pad plane and while the pad and wafer are rotated concurrently or countercurrently (see Japanese Patent Application Publication No. Kokai Hei 6[1994]-21028, Hei 7[1995]-266219, Hei 8[1996]-192353, and Hei 8[1996]-293477).

Hard foamy urethane sheets, polyester fiber non-woven cloths, felts, polyvinyl alcohol fiber non-woven cloths, nylon fiber non-woven cloths, and ones obtained by flowing foamable urethane resin solutions on these non-woven cloths and by subsequently foaming and curing them are used as pads (polishers) to be integrated with such polishing devices.

When a wafer is polished by using any of the aforementioned polishing devices, its pad becomes worn as a result of polishing, and therefore, the pad is subjected to dressing and washing operations by using a pad conditioning device after one or multiple wafers have been polished for the purpose of roughening (repairing) the pad. Concrete examples of heretofore proposed pad conditioning devices which serve such pad roughening functions include the combination of a dressing disc and a washing solution, high-pressure washing solution spray nozzles (see Japanese Patent Application Publication No. Kokai Hei 3[1991]-10769, Hei 10[1998]-202502, Hei 10[1998]-235549, and Hei 10[1998]-244459), combination of a dressing disc and a washing brush (see Japanese Patent Application Publication No. Kokai Hei 10[1998]-244458), and the combination of a cup hold-type dressing whetstone, a compressive washing solution spray nozzle, and a washing brush (see Japanese Patent Application Publication No. Kokai Hei 10[1998]-244458).

Polishing pad components are thus conditioned repeatedly, and once a polishing pad component reaches its wear limit, it is exchanged with a new polishing pad component. Such a polishing pad component is obtained by pasting a polishing cloth or polyurethane sheet (referred to as a "pad," "polishing cloth," or "polisher") onto an aluminum or stainless steel attachment panel (polisher supporter), and such a polishing cloth is reloaded manually by an operator. The peeling of the polishing cloth and its pasting onto the attachment panel, however, are cumbersome during such a polishing cloth reloading operation, and furthermore, advanced skills are required, as a result of which the utilization efficiency of the polishing device decreases. It is in such a context that this method is replaced by one wherein a new polishing pad component which has been obtained by preliminarily pasting an unused polishing cloth onto an attachment panel is prepared and wherein a used and worn polishing pad component is exchanged with this new polishing pad component.

Even in such a method, however, a manual operation wherein a worker enters the polishing device in person is unavoidable, and cumbersome bolt attachment and detachment procedures are required for exchanging polishing pad components. It is in such a context that devices for automatically exchanging polishing pad components have been proposed, for example, by Japanese Patent Application Publication No. Kokai Hei 8[1996]-174406 and Hei 10[1998]-230449. In such a case, however, a polishing pad component is above a disc, the diameter of which is large and wherein a wafer, the plane of which to be polished faces downward, is polished while said wafer is pressed from above onto the pad plane of the polishing pad component. For this reason, the diameter of the disc (as well as of the polishing pad component) is large in comparison with the wafer diameter, as a result of which the structure of the automatic exchange device for exchanging such large polishing pad components becomes large and complicated, accompanied by high production costs.

Regarding the polishing devices mentioned in the aforementioned patent publications (CMP devices), furthermore, the planes of wafers to be polished face downward, and therefore the end point of the polishing operation may be estimated by decoding the variations of voltages or currents for rotating and driving the polishing pad component, wafer, etc., or the end point of the polishing operation may alternatively be estimated by configuring a laser beam transmission window on a disc and by monitoring the wafer polishing state while a laser beam is irradiated onto the plane of the wafer to be polished which is polished (see Japanese Patent Application Publication No. Kokai Hei 6[1994]-216095, Hei 8[1996]-172118, Hei 9[1997]-262743, and Hei 10[1998]-199951).

SUMMARY OF THE INVENTION

In contrast with these CMP devices, a CMP device wherein a wafer, the plane of which to be polished faces upward, is retained by the suction of a wafer chuck mechanism on an index table, wherein a polishing pad component which is axially supported on a spindle axle which is positioned above the wafer is pressed onto the wafer from above while its pad plane faces downward, and wherein the wafer is polished by rotating said wafer and polishing pad component has been proposed and put to practical uses (see Japanese Patent Application Publication No. Kokai Hei 10[1998]-303152 and Hei 11[1999]-156711). The polishing pad diameter of such a CMP device is small in comparison with the wafer diameter, and since the plane to be polished faces upward, it is easy to measure the film thickness during the polishing operation or to judge the end of the polishing operation. Since the diameter of the polishing pad component is smaller than those of the polishing pad components of the known CMP devices, furthermore, the exchange operation can be advantageously facilitated.

Such a CMP device wherein the polisher diameter is small in comparison with the wafer diameter, however, is characterized by a high utilization efficiency of the polishing plane (pad plane) of the polisher (polishing pad component), and accordingly, the depressions of the polishing plane of the polisher tend to become congested. It is necessary to increase the dressing frequency of such a CMP device for the purpose of maintaining the required polishing performances, but since the dressing is synonymous with the shaving of the polisher surface, the life of the polisher itself becomes shortened, as a result of which the period between operations for exchanging polishing pad components become shorter, and the exchange frequency increases. As has been mentioned above, furthermore, the polishing pad component is attached to the spindle axle while its pad plane faces downward, as a result of which it becomes difficult to achieve a favorable precision during the exchange operation, and the operative efficiency is problematically unfavorable.

An object of the present invention, which has been conceived in response to the foregoing problems, is to provide a polishing pad component exchange device and a corresponding method which are capable of automating polishing pad component exchange operations and of improving the polishing pad component exchanging operative efficiency. In order to solve the aforementioned problems, the polishing device of the present invention may, for example, be comprised of an object retention mechanism (e.g., wafer chuck mechanism of application embodiments) which retains an object to be polished (e.g., wafer of application embodiments) while its plane to be polished faces upward, a polishing pad component which possesses a polishing plane which polishes said plane to be polished while in contact with it, a pad retention mechanism (e.g., polishing head (2) of application embodiments) which retains said polishing pad component while said polishing plane faces downward, and a shift mechanism (e.g., shift mechanisms (7) and (107) of application embodiments) which enables a relative displacement of said polishing pad component in relation to said plane to be polished, and said plane to be polished is constituted to be polished based on the relative displacement of said polishing pad component while it is in contact with said plane to be polished. Such a polishing device, furthermore, possesses a fixation and retention mechanism which fixes and retains said polishing pad component in a detachable fashion while said polishing plane faces downward at the lower end of the polishing head, wherein the displacement distance of said shift mechanism ranges at least from the polishing position of said plane to be polished to the exchange position of said polishing pad component, and said polishing pad component is automatically exchanged while attached to and detached from the polishing head by said fixation and retention mechanism.

Regarding this polishing device, the polished object is retained by the object retention mechanism while its plane to be polished faces upward, whereas the polishing plane of the polishing pad component which is retained by the pad retention mechanism is pressed onto the plane to be polished from above, whereas the plane to be polished is polished based on the relative shift of the two (relative rotational shift) caused by the shift mechanism. In such a case, the polishing plane of the polishing pad component is generally smaller than the plane to be polished, as a result of which the polishing frequency tends to become high. Since the polishing pad component is constituted to entail automatic attachments/detachments and exchanges in relation to the pad retention mechanism using the fixation and retention mechanism and the shift mechanism which enable a shift to the polishing pad component exchange position, a used polishing pad component can be automatically exchanged with a new polishing pad component, so that the polishing pad exchanging operative efficiency can be improved.

The polishing device of the present invention is alternatively constituted by an object retention mechanism which retains a polished object while its plane to be polished faces upward, a polishing pad component which possesses a polishing plane which polishes said plane to be polished while in contact with it, a pad retention mechanism which retains said polishing pad component while said polishing plane faces downward, a shift mechanism which enables a relative displacement of said polishing pad component in relation to said plane to be polished, and a transportation mechanism (e.g., polishing pad transportation robot (18) of application embodiments) which exchanges said polishing pad component while it is transported in relation to said pad retention mechanism, and said plane to be polished is constituted to be polished based on the relative displacement of said polishing pad component while it is in contact with said plane to be polished. Regarding this polishing device, furthermore, a fixation and retention mechanism which fixes and retains said polishing pad component in a detachable fashion while said plane to be polished faces downward is at the lower end of the polishing head, wherein the pad retention mechanism is shifted to the polishing pad exchange position by the shift mechanism, so that said polishing pad component, which is transported by said transportation mechanism, is automatically exchanged while attached to and detached from said polishing head by said fixation and retention mechanism.

Based on such a constitution of the exchange device, the polishing pad component is constituted to be automatically exchanged while attached to and detached from said polishing head by said fixation and retention mechanism, and therefore, a used polishing pad component can simply be exchanged with a new one automatically. Additional automating benefits can, furthermore, be obtained based on the transportation of the polishing device, which has been thus attached and/or detached, by the transportation mechanism, based on which the exchanging operative efficiency can be phenomenally improved.

Incidentally, regarding the aforementioned invention, it is desirable for the transportation mechanism to possess an arm which is capable of gripping the polishing pad component at its front end. In such a case, the polishing pad component which is gripped by the arm component is transported to the lower end of the pad retention mechanism during an operation for attaching the polishing pad component to the polishing head, and the polishing pad component is fixed to and retained by the fixation and retention mechanism, based on which the automatic attachment of the polishing pad component can be simplified.

Regarding the foregoing constitution, a temporary binding mechanism temporarily binds the polishing pad component to the polishing head when the fixation and retention mechanism is inoperative. In such a case, the polishing pad component can be caused by the temporary binding mechanism to be temporarily bound to and supported by the polishing head.

The aforementioned polishing pad component may be constituted by a polisher which polishes said plane of the object to be polished while in contact with it and a polisher supporter which retains said polisher planewise. In such a case, the polishing pad component can be easily renewed by simply peeling the polisher from the polisher supporter and pasting a new polisher onto it with regard to a used polishing pad component which has been detached from the pad retention mechanism.

Incidentally, the fixation and retention mechanism may be constituted to induce the fixation and retention of the polishing pad component to and by the lower end of the polishing head based on vacuum suction. Moreover, the polishing pad component may be constituted by a polisher and a polisher supporter while said polisher supporter is constituted by a magnet in such a way that the fixation and retention mechanism will cause the fixation and retention of the polishing pad component to and by the lower end of the polishing head based on a magnetic force. The polishing pad component may, furthermore, be constituted to induce the fixation and retention of the polishing pad component to and by the lower end of the polishing head via a fixation mechanism (e.g., clamp mechanism, bolt stopper mechanism, etc.). The polishing pad components can be automatically exchanged with ease based on any of these constitutions.

The polishing device thus constituted may also possess a storage shelf which stores the polishing pad component, which is exchanged while attached to and/or detached from the polishing head, after it has been transported by said transportation mechanism. In such a case, multiple polishing pad components can be stored on the storage shelf, based on which the exchanging operative efficiency can be further improved.

The aforementioned polishing device may also be constituted to possess a polisher reloading mechanism which automatically peels said polisher from said polisher supporter and which automatically pastes a new polisher onto said polisher supporter in relation to said polishing pad component, which, after having been used, has been detached from the polishing head for exchange purposes. When the polisher is thus reloaded automatically, the polishing pad component exchanging operative efficiency can be farther upgraded.

Incidentally, the transportation mechanism may in this case be constituted not only to transport the polishing pad component, which, after having been used, has been detached from said pad retention mechanism for exchange purposes, to said polisher reloading mechanism but also to transport said polishing pad component the polisher of which has been reloaded by said polisher reloading mechanism onto said storage shelf. In such a case, the entire exchanging operation can be smoothly carried out.

The method of the present invention for exchanging polishing pad components, on the other hand, is constituted to utilize the polishing device of the present invention described above for exchanging polishing pad components in relation to the pad retention mechanism. If this method is implemented, the polishing pad component exchanging operative efficiency can be improved.

Incidentally, an alternative polishing device of the present invention possesses a polishing pad component which has been obtained by pasting a polisher to the rear plane of a polisher supporter which possesses a annular channel on its outer circumference and which possesses an interlocking unit which serves a positioning function on its rear plane, a head which is axially supported on a spindle axle which possesses an axial core along the perpendicular direction and which is capable of drawing said polishing pad component based on vacuum suction, an (un)lift mechanism for said spindle axle, a shift mechanism which is capable of inducing reciprocal displacements of said spindle axle between left and right and which is capable of inducing the shift of said spindle axle to the exchange position for said polishing pad, a transportation robot which is positioned along the extension of the shift orbit of the central point of said polishing pad component, which has been attached to the head of said spindle axle, between left and right, which induces the detachment of the polishing pad component from the transported spindle axle via an arm, which induces the importation of the polishing pad component onto a storage shelf or the exportation of the polishing pad component from said storage shelf based on a rotating action, and which induces the importation of the polishing pad component onto the head of the spindle axle based on another rotating action, and said storage shelf, while a gap is secured between itself and the rotation axis of said transportation robot and which can be reciprocally displaced forward and backward.

In an alternative method of the present invention for exchanging polishing pad components, furthermore, a polishing pad component which has been obtained by pasting a polisher to the rear plane of a polisher supporter which possesses a annular channel on its outer circumference and which possesses an interlocking unit which serves a positioning function on its rear plane is attached to and/or detached from a head which is axially supported on a spindle axle by using the aforementioned device for exchanging a polishing pad component based on the following processes (1) through (12):

(1): One whereby the arm of the transportation robot is elevated to the polishing pad component detachment height position vis-à-vis the head and whereby said arm is subsequently rotated by 90 along the head direction, (2): One whereby a polishing pad component which is drawn toward the spindle axle, which possesses an axial core along the perpendicular direction, based on vacuum suction is displaced to the side of said transportation robot, which is positioned along the extension of the shift orbit of the central point of said polishing pad component between left and right, by said shift mechanism and then caused to stop at the exchange position, (3): One whereby two pairs of rolls which have been attached to the arm of said transportation robot based on the contraction of the claw width of said arm are inserted into annular channels on the outer circumference of a polishing pad component attachment panel for the purpose of gripping the polishing pad component, (4): One whereby the vacuum suction of the head is subsequently cancelled and whereby the detachment of the polishing pad component from the head is facilitated by feeding compressed air into said head, (5): One whereby the arm of the transportation robot is rotated by 90 in the opposite direction and whereby said arm is subsequently elevated or lowered to a position corresponding to the height of the platform of the storage shelf on which the polishing pad component is mounted, (6): One whereby the storage shelf is caused to move forward toward the transportation robot side and whereby the polishing pad component is mounted on the platform of the storage shelf based on the expansion of the claw width of the arm of the transportation robot, (7): One whereby the storage shelf is caused to recede, (8): One whereby the arm of the transportation robot is elevated or lowered to a position corresponding to a height at which a new polishing pad component can be gripped, (9): One whereby said storage shelf is caused to move forward toward the transportation robot and whereby the two pairs of rolls which have been attached to the arm of said transportation robot are inserted into annular channels on the outer circumference of a new polishing pad component attachment panel based on the contraction of the claw width of said arm for the purpose of gripping the polishing pad component, (10): One whereby the storage shelf is caused to recede, (11): One whereby the arm of the transportation robot is rotated by 90 along the head direction and whereby the polishing pad component is subsequently drawn toward the head based on the vacuum suction of said head, (12): One whereby the claw width of the arm of the transportation robot is expanded and whereby the spindle axle is caused to shift between left and right away from said transportation robot, and (13): One whereby, when the prevailing polishing pad component becomes worn and where said polishing pad component must be exchanged with a new polishing pad component, the aforementioned processes of (2) through (12) are repeated.

DESCRIPTION OF THE PREFERRED EMBODIMENTS

Figure 2:
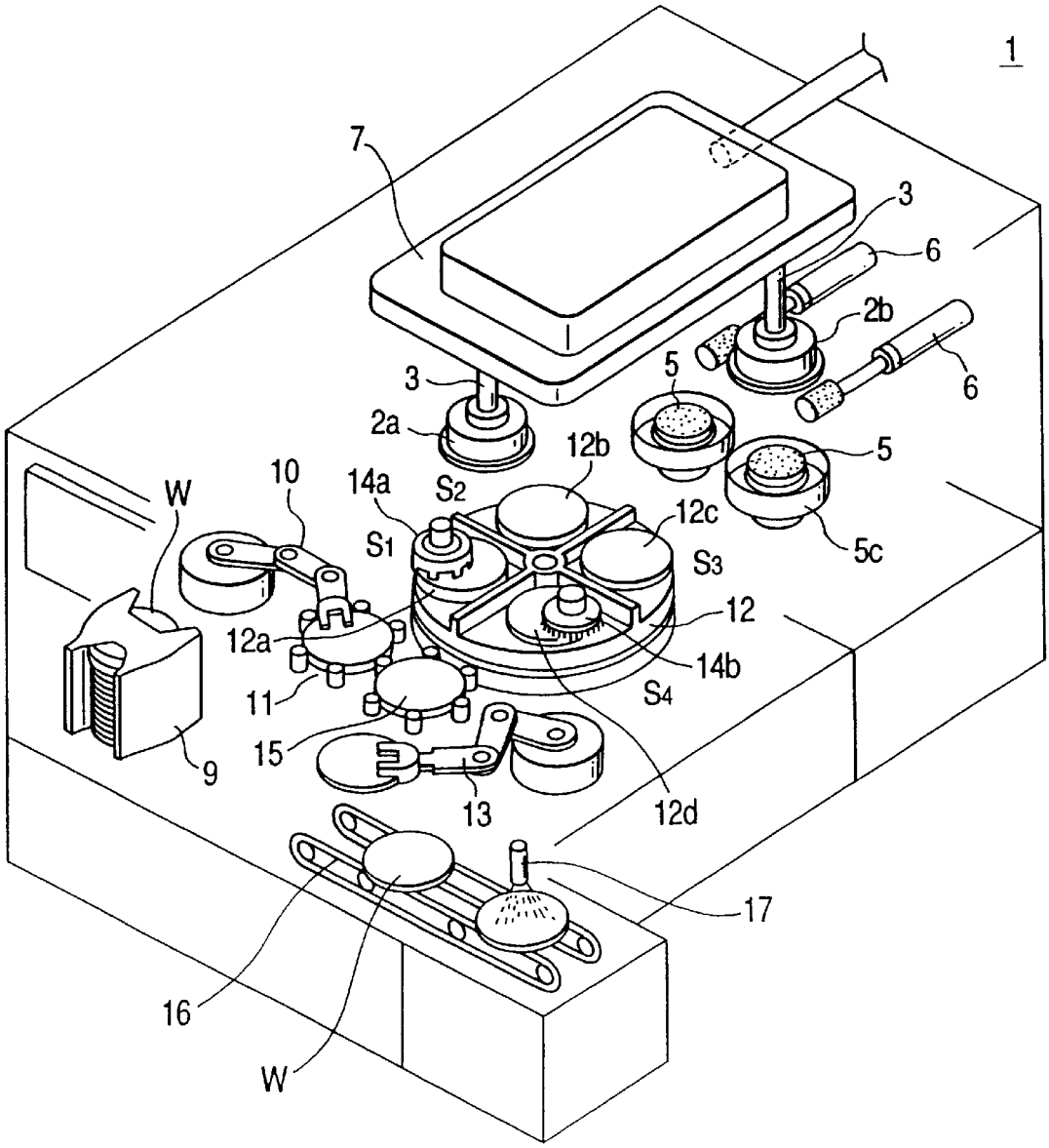
FIG. 2 shows an oblique view of the constitution of the polishing device of the present invention.
Figure 3:
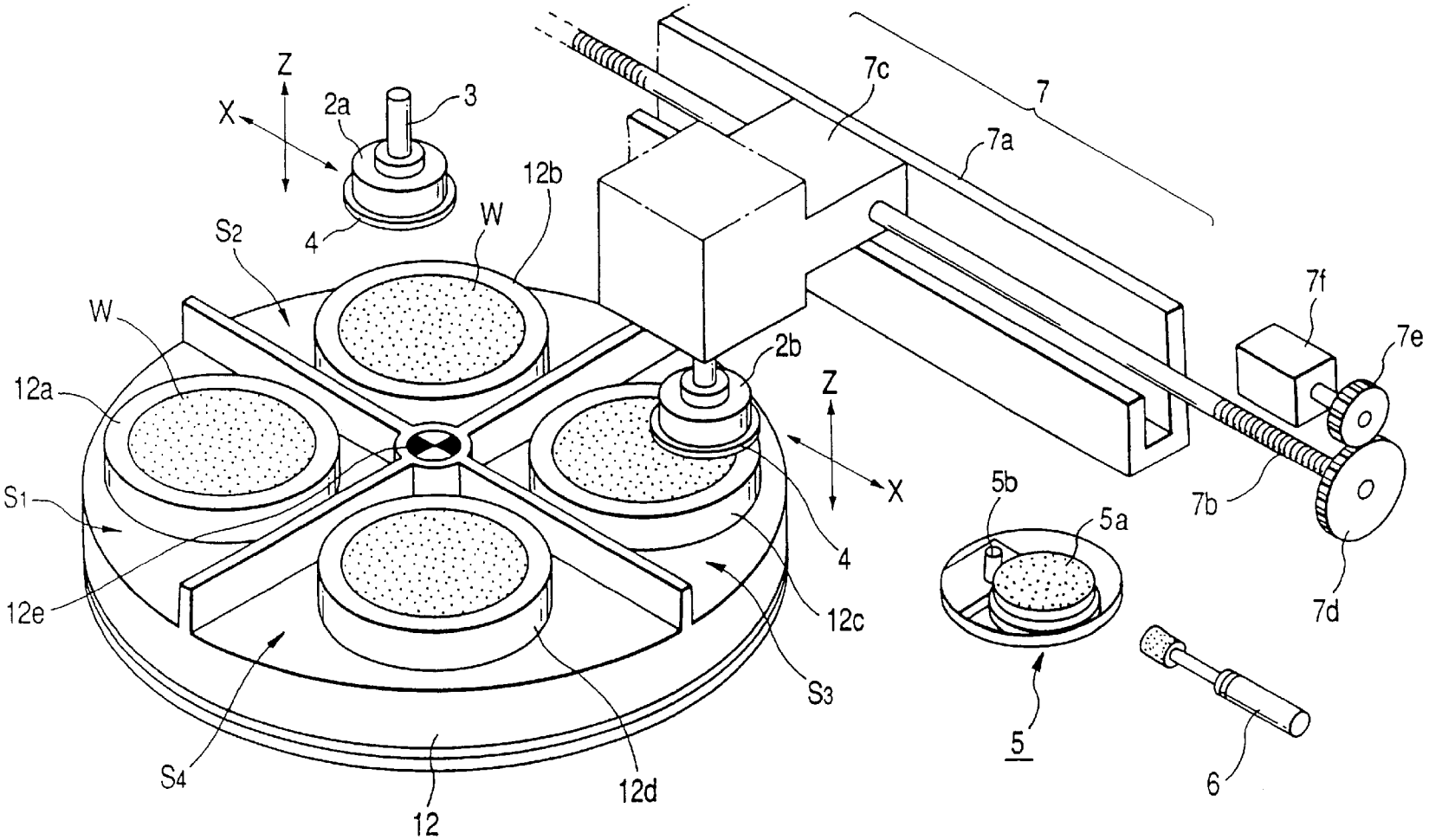
FIG. 3 shows an oblique view of the main components of the aforementioned polishing device.

In the following, preferred embodiments of the present invention will be explained with reference to figures. First, a chemical-mechanical polishing device, namely the "CMP device," to which the device and method of the present invention for exchanging polishing pad components can be applied will be explained. The overall constitution of this index-type CMP device (1) will be explained first with reference to FIGS. 2 through 5. The CMP device (1) possesses a polishing head (2) which incorporates rough polish-grade polishing head (2*a*), medium polish-grade polishing head (2*b*), and finish polish-grade polishing head (2*c*) (incidentally, the finish polish-grade polishing head (2*c*) is not shown in either FIG. 2 nor FIG. 3). The polishing head (2) is attached to the rotation axle (3), whereas the pulley (3*c*) is stretched across the gear (3*b*), which is attached to the drive axle for the motor (3*a*), and the gear (3*d*), which is attached to the rotation axle (3). The rotation of the motor (3*b*) is transmitted to the rotation axle (3) via the power transmission system thus constituted, based on which the polishing head (2) is rotated and driven.

The polishing pad component (4) is attached to the lower end of this polishing head (2) in a detachable fashion. In this case, a rough polish-grade polishing pad component is attached to the rough polish-grade polishing head (2*a*), whereas a medium polish-grade polishing pad component is attached to the medium polish-grade polishing head (2*b*), whereas a finish polish-grade polishing pad component is attached to the finish polish-grade polishing head (2*c*).

The pad conditioning mechanism (5) is provided within the CMP device (1), where operations for dressing the polishing pad component (4), etc. are carried out. The dressing disc (5*a*), spray nozzle (5*b*), and the rotatable washing brush (6) are provided on said pad conditioning mechanism (5), as the figure indicates.

The polishing head (2) is constituted to be shifted by the shift mechanism (7) which possesses a rail (7*a*), feed screw (7*b*), and shifter (7*c*), which has been screwed into the feed screw (7*b*), while the polishing head (2) is attached to the shifter (7*c*). The feed screw (7*b*) is rotated and driven by the motor (7*f*) via the gears (7*d*) and (7*e*), based on which the shifter (7*c*) is shifted along the direction of x shown in FIG. 3. The polishing head (2), furthermore, can be shifted along the direction Z shown in FIG. 3 by an (un)lift mechanism constituted by the air cylinder (8).

The storage cassette (9), in which the wafer (W), which serves as a polishing object, is to be stored, is additionally provided on the CMP device (1) while the wafer transportation robot (10), which serves a function of transporting the wafer (W) in relation to said storage cassette (9), is similarly provided. The wafer transportation robot (10) is a robot which transports not only a yet-to-be-polished wafer (W) from the storage cassette (9) to the index table (12) but also a polished and finished wafer (W). The wafer temporary mount platform (11), on which the wafer (W) is to be temporarily mounted, is provided midway along the present transportation path.

The index table (12) possesses four wafer chuck mechanisms (12*a*), (12*b*), (12*c*), and (12*d*) which are spaced at an equal intervals along a circular orbit around the axle (12*e*), which serves as an axial core, and which is partitioned into the wafer loading and unloading zone S1, rough polish zone S2, medium polish zone S3, and the finish polish zone S4. Incidentally, as FIG. 5 indicates, a rough polish-grade polishing pad component which is retained by the rough polish-grade polishing head (2*a*), a medium polish-grade polishing pad component which is retained by the medium polish-grade polishing head (2*b*), and a finish polish-grade polishing pad component which is retained by the finish polish-grade polishing head (2*c*) are positioned respectively above the rough polish zone S2, medium polish zone S3, and the finish polish zone S4.

The wafer transportation robot (10) also functions as an unloading transportation robot which transports the polished and finished wafer (W). After the polished and finished wafer (W) has been unloaded onto the belt conveyer (16) by said robot (10), it is fed into and washed by the wafer washing mechanism (17) via said belt conveyer (16). Incidentally, the chuck dresser (14*a*) and chuck washing mechanism (14*b*) dress and wash the wafer chuck mechanisms (12*a*), (12*b*), (12*c*), and (12*d*) of the index table (12). Regarding this device, the wafer (W) within the storage cassette (9) is mounted onto the wafer temporary mount platform (11) by the wafer transportation robot (10), and after its rear plane has been washed, it is transported and mounted onto the wafer chuck mechanism (12*a*) in the wafer loading and unloading zone S1 of the index table (12) by the wafer transportation robot (10). Next, the index table (12) is rotated by 90 clockwise, and the wafer (W) is transferred to the rough polish zone S2. Next, the rough polish-grade polishing head (2*a*), which is axially supported on the rotation axle (3), descends, and the rough polish-grade polishing pad component (4) is pressed onto the plane of the wafer (W) to be polished, followed by the execution of a rough polishing operation by rotating the wafer and spindle axle.

The index table (12) is further rotated by 90 clockwise, as a result of which the wafer (W) is transferred to the medium polish zone S3. It is here that the medium polish-grade polishing head (2*b*), which is axially supported on the rotation axle (3), descends, and a medium polishing operation is carried out by rotating the wafer and spindle axle. Next, the index table (12) is further rotated by 90 clockwise, as a result of which the wafer (W) is transferred to the finish polish zone S4. It is here that the finish polish-grade polishing head (2*b*), which is axially supported on the rotation axle (3), descends, and a finish polishing operation is carried out by rotating the wafer and spindle axle.

Next, the index table (12) is further rotated by 90 clockwise, as a result of which the wafer (W) is returned to the wafer loading and unloading zone S1. The wafer (W) which has been thus polished and finished is mounted onto the belt conveyer (16) by the wafer transportation robot (10), and after it has been washed by the wafer washing mechanism (17), it is transferred to subsequent processes.

Thus, a new wafer (W) becomes transported into the wafer loading and unloading zone S1 after every 90 rotation of the index table (12), followed by its rough polish, medium polish, finish polish, unloading, and washing in proper order. While polishing operations are carried out in the zones S1 through S4, furthermore, a wafer (un)loading operation is carried out in the zone S1, whereas the chuck mechanisms are washed by the chuck washing mechanisms (14*a*) and (14*b*) during spare periods.

Figure 4:
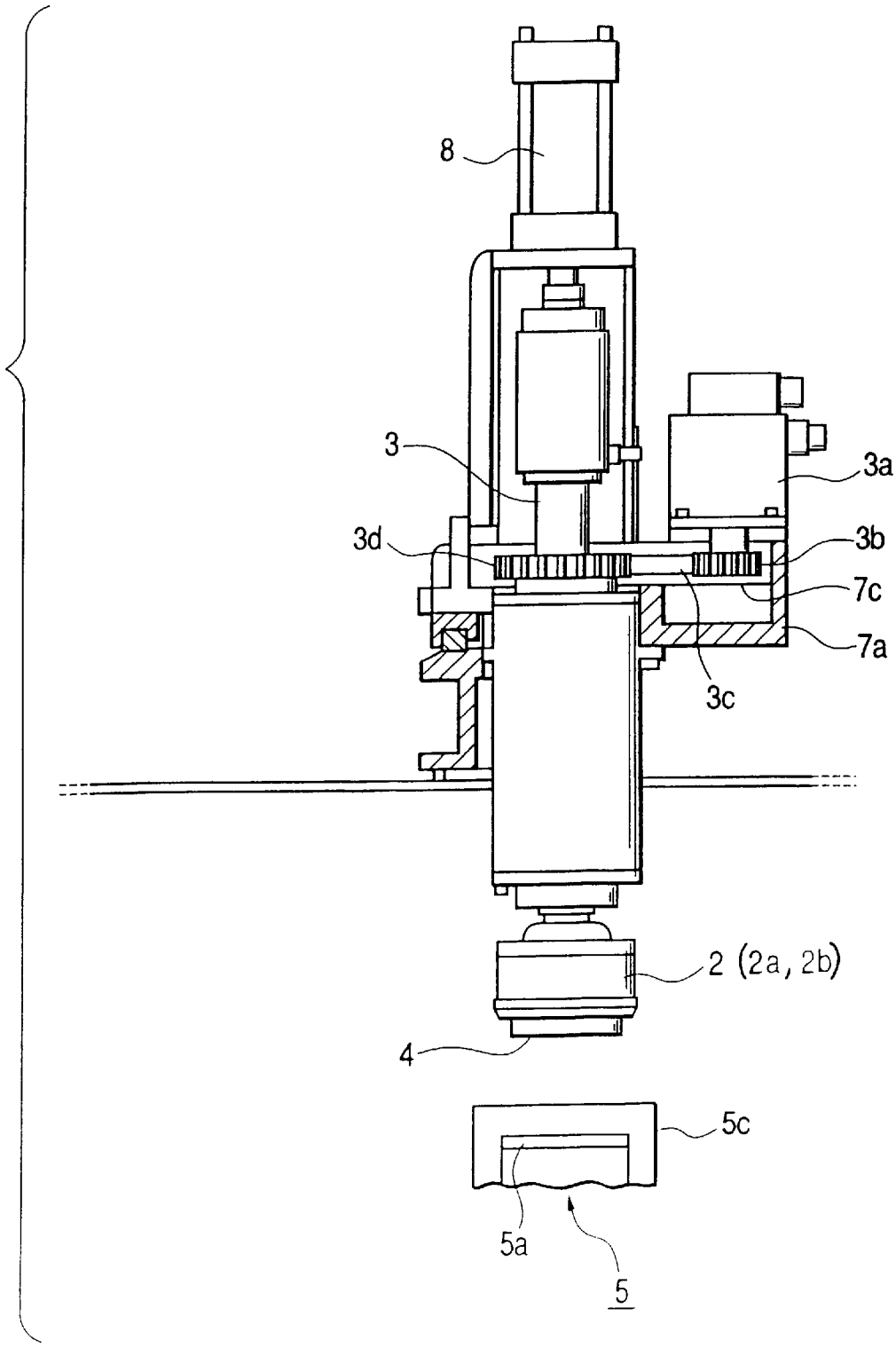
FIG. 4 shows a frontal view of the spindle axle, polishing head, pad retention mechanism, and pad conditioning mechanism of the aforementioned polishing device.
Figure 5:
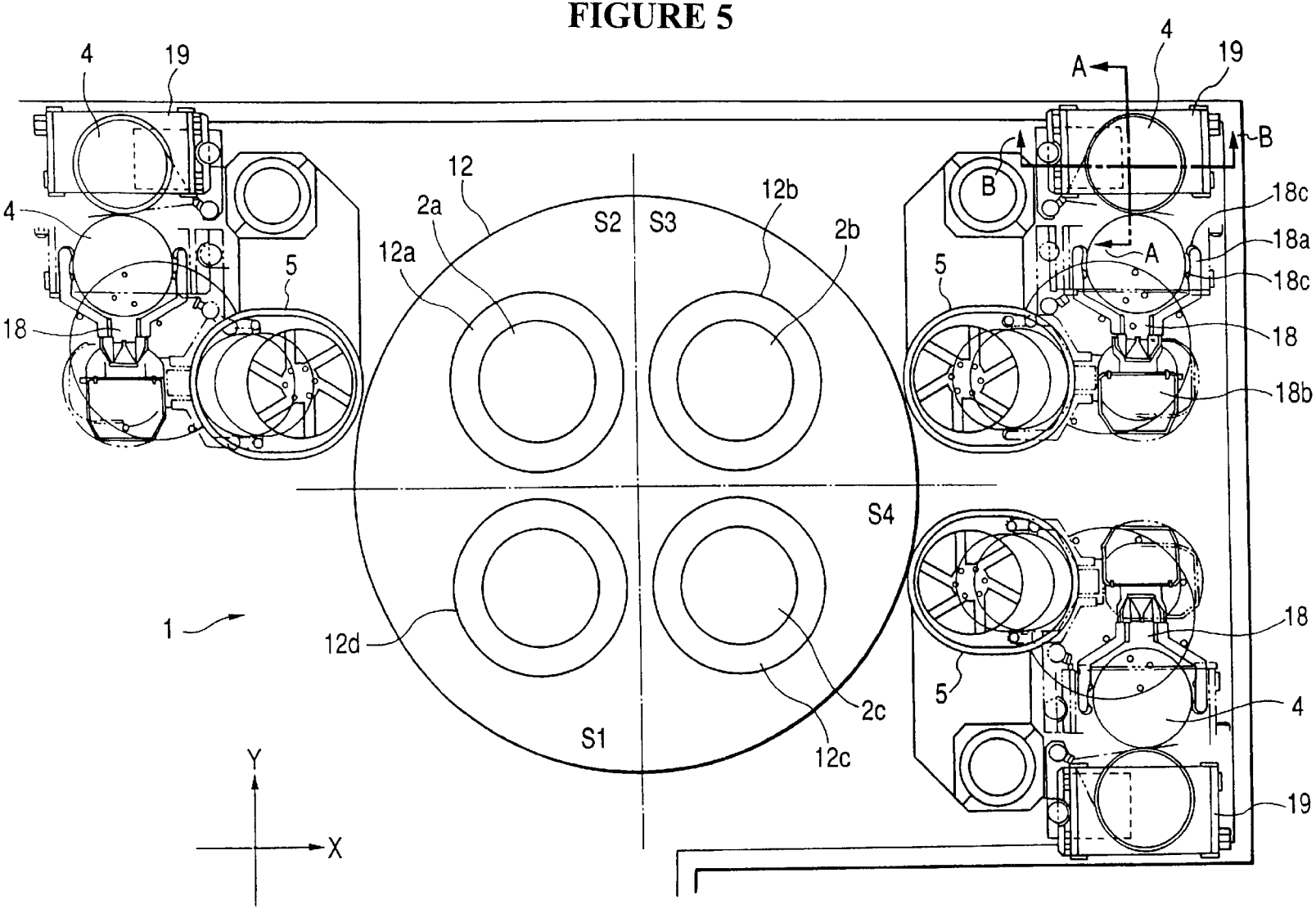
FIG. 5 shows a plane view of a CMP device equipped with the polishing pad exchange device of the present invention.

When the polisher of the polishing pad component (4) becomes worn as a result of repeated wafer polishing operations, the rotation axle (3) is caused to recede between left and right (X-axis direction), and after the polishing pad component has been pressed onto the dressing disc (5*a*) of the pad conditioning mechanism (5), the pad is rotated for the purpose of repairing the pad (see FIG. 4).

As has been mentioned above, "dressing" hereby signifies an operation for shaving the surface of the polisher, and after the polisher has become severely shaved as a result of dressing, it becomes necessary to exchange the polishing pad component (4). The polishing device of the present example possesses a polishing pad automatic exchange mechanism which enables an automatic exchange of the polishing pad component (4). This mechanism will be explained with reference to FIG. 1 and FIGS. 5 through 10.

Figure 6:
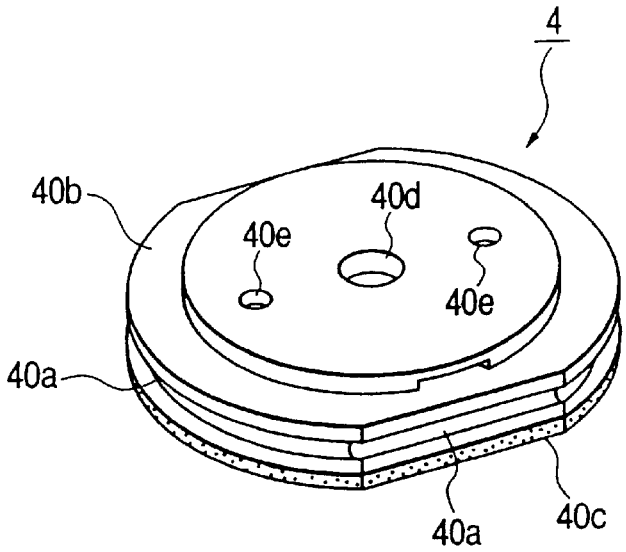
FIG. 6 shows an oblique view of the polishing pad component which serves as an exchange object for the exchange device of the present invention.

Prior to the explanation of this exchange mechanism, the constitution of the polishing pad component (4) and the constitution for inducing its fixation and retention to and by the lower end of the polishing head (2) will be explained with reference to FIGS. 1 and 6. The polishing pad component (4) is constituted by pasting the polishing cloth (40*c*) (polisher) onto the lower plane of the attachment panel (40*b*), which is made of a disc-shaped metal (e.g., stainless steel, aluminum, etc.) object and which possesses an annular channel (40*a*) along its outer circumference, whereas the upper plane of the attachment panel (40*b*) serves as a junction plane to be interfaced with the polishing head (2), and the depression (40*d*), into which the positioning protrusion (23) of the polishing head (2) is to be inserted, and the depression (40*e*), into which the positioning pin (24) of the head is to be inserted, furthermore, are provided on this plane. Incidentally, the positioning depression and protrusion may be oppositely designated in relation to the polishing head and polishing pad component. A positioning protrusion and a positioning pin may, for example, be provided on the upper plane of the polishing pad component while depressions into which they are to be inserted are provided on the polishing head plane.

Figure 1:
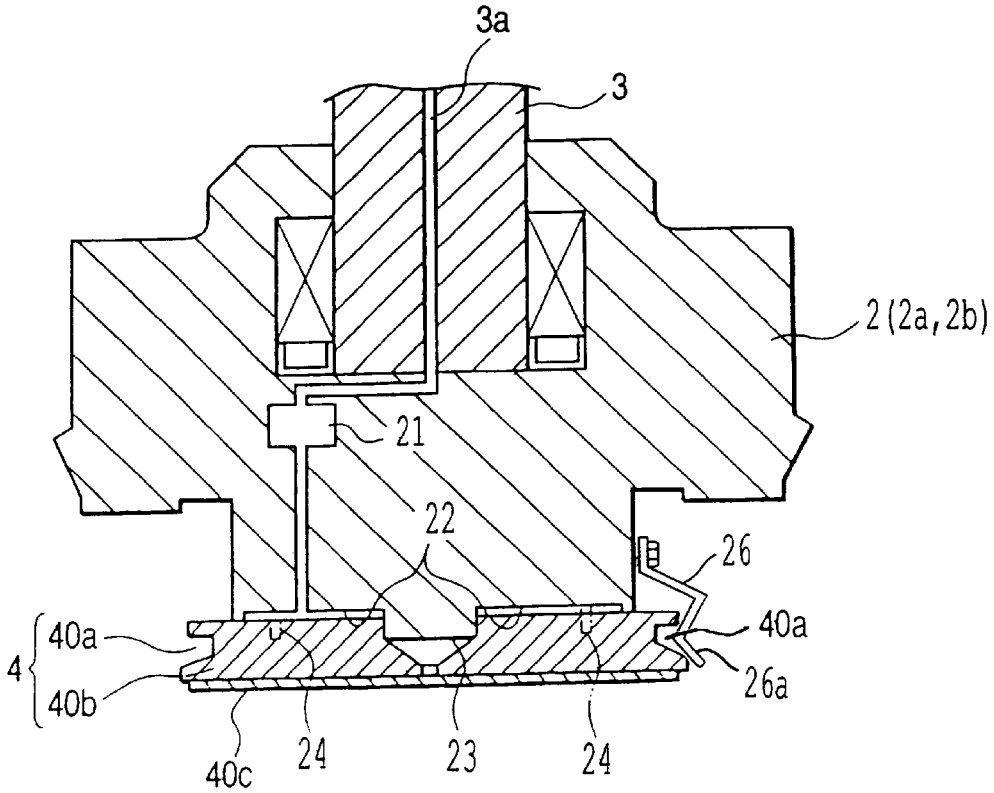
FIG. 1 shows a cross-sectional view of a polishing head and a pad retention mechanism which has been attached to it in a detachable fashion based on vacuum suction in the polishing device of the present invention.

The polishing head (2) is constituted to interface with the polishing pad component (4) based on vacuum suction, and as the cross-section of FIG. 1 indicates, it possesses the flow path (21) which is connected to the flow path (3*a*) provided within the rotation axle (3), in its interior while the depression (22), which is connected to the flow path (21), is formed on its lower plane, with which the polishing pad component (4) is to be interfaced. When the polishing pad component (4) is interfaced with the polishing head (2), therefore, the pressures of the flow path (3*a*) of the aforementioned rotation axle (3) and flow path (21) are lowered by a vacuum pump which is connected to the flow path (3*a*), and the polishing pad component (4) is thereby caused to be fixed to and retained by the polishing head (2) based on vacuum suction. The positioning protrusion (23) and positioning pin (24) are on the lower plane of the polishing head (2) for positioning purposes during this fixation and retention operation.

Incidentally, when the polishing pad component (4) is thus caused to be drawn toward the lower end of the polishing head (2) based on vacuum suction, it is necessary for the polishing pad component (4) to be supported and retained from below until the pressure of the suction plane (space) becomes sufficiently lowered via the flow path (21). For this reason, multiple temporary binding components (26) are provided at multiple sites along the outer circumference on the lower end of the polishing head (2). Each temporary binding component (26) is made of an elastically deformable metallic sheet, etc., and it is constituted to bind the polishing pad component (4) temporarily while its temporary retention protrusion (26*a*), which protrudes inward, is inserted into the annular channel (40*a*).

When the polishing pad component (4) which is thus fixed and retained based on vacuum suction is to be detached from the polishing head (2), the operation of the vacuum pump is terminated, as a result of which the vacuum suction force expires. In such a case, the vacuum pump is replaced by compressed air from a compressor for compressing air in the flow path (3*a*) and the flow path (21), as a result of which the retrieval and detachment of the polishing pad component (4) are facilitated.

When the temporary binding components (26) are similarly provided, the polishing pad component (4) thus detached can be temporarily retained by the temporary binding components (26). When the vacuum pump ceases to function for some reason, furthermore, the polishing pad component (4) drops onto the wafer (W), which serves as a polishing object. Such an inadvertent drop of the polishing pad component (4) can also be prevented by the temporary binding components (26).

The wafer (W), which serves as a polishing object, has already undergone a fair number of processes prior to its entry into the polishing process by the present CMP device. Furthermore, the polishing pad component (4) is positioned above the wafer (W). As has been mentioned above, therefore, the wafer (W), in which considerable time and money have both been invested, becomes broken if the vacuum suction force becomes unavailable due to some unforeseen reason. Such a destruction of the wafer (W) can therefore be prevented by providing the temporary binding components (26).

Since the temporary binding components (26) are constituted by springy components, furthermore, the polishing pad component (4) can be detached by a slight downward force on the polishing pad component (4) while it is engaged with said temporary binding components (26).

The polishing pad component (4), which is thus attached to and/or detached from the polishing head (2) based on vacuum suction, is transported by the polishing pad transportation robot (18) for exchanging purposes. This polishing pad transportation robot (18) is constituted to possess the arm (18*a*), rotation axle (18*b*), and the roller (18*c*), which is attached to said arm, and it enables the automatic transportation of the polishing pad component (4) in relation to the polishing pad storage shelf (19).

Figure 7:
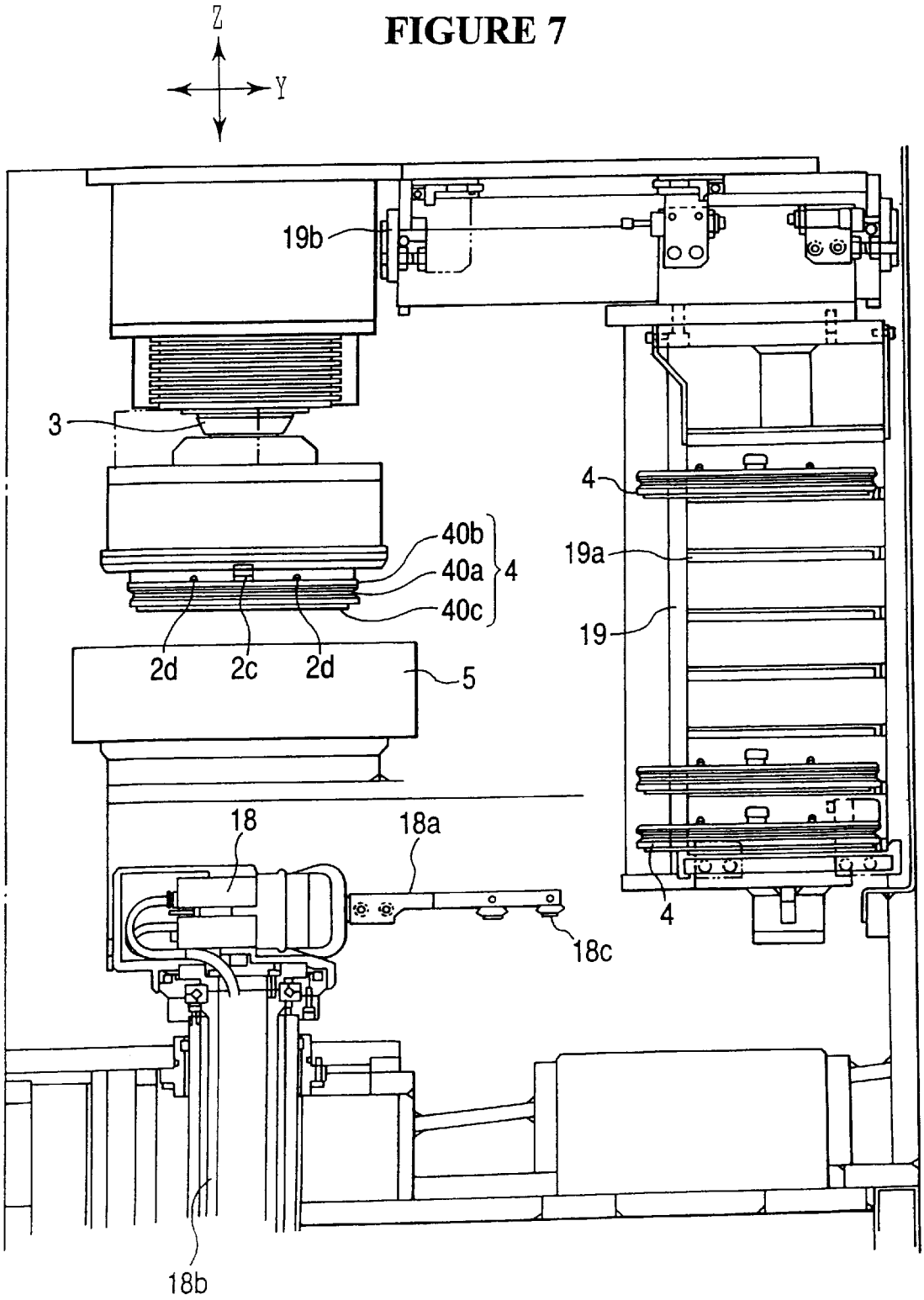
FIG. 7 shows a partial profile view of the aforementioned CMP device along the A—A line in FIG. 5.
Figure 8:
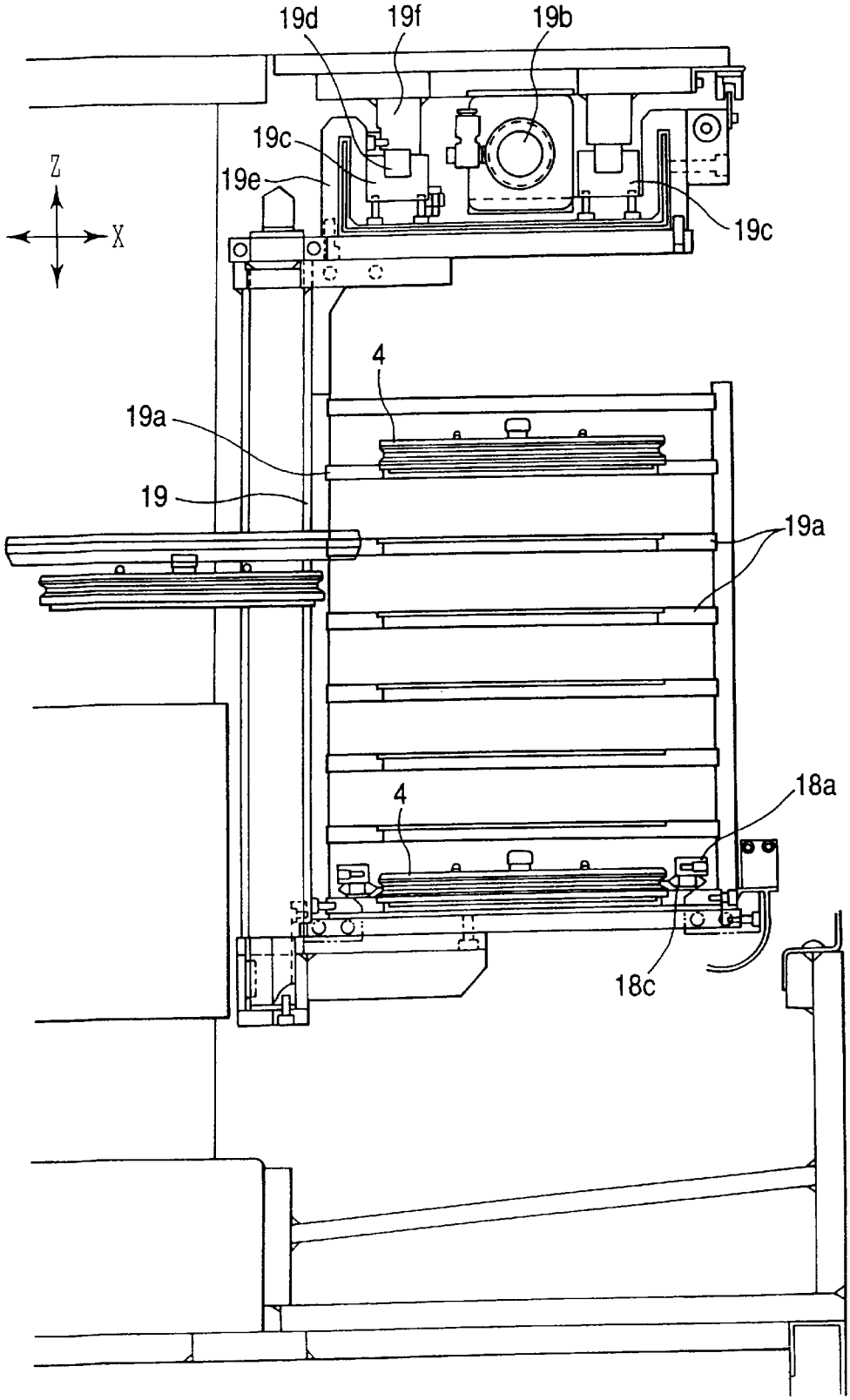
FIG. 8 shows a partial profile view of the aforementioned CMP device along the arrow B in FIG. 5.

The polishing pad storage shelf (19) possesses multiple platforms (19*a*), on which polishing pad components are to be mounted, and it is thus compartmentalized, as FIGS. 7 and 8 indicate. A shift mechanism which is capable of reciprocally displacing this polishing pad storage shelf (19) forward and backward (Y axis direction) is provided above the polishing pad storage shelf (19), and said shift mechanism is constituted by the cylinder (19*b*), rail (19*c*), and the slide component (19*d*). The top of the storage shelf (19) is fixed to the support axle (19*f*) of the slide component (19*d*) via the component (19*e*). The storage shelf (19) can therefore be shifted back and forth by displacing the slide component (19*d*) back and forth above the rail (19*c*) via the cylinder (19*b*).

Figure 9:
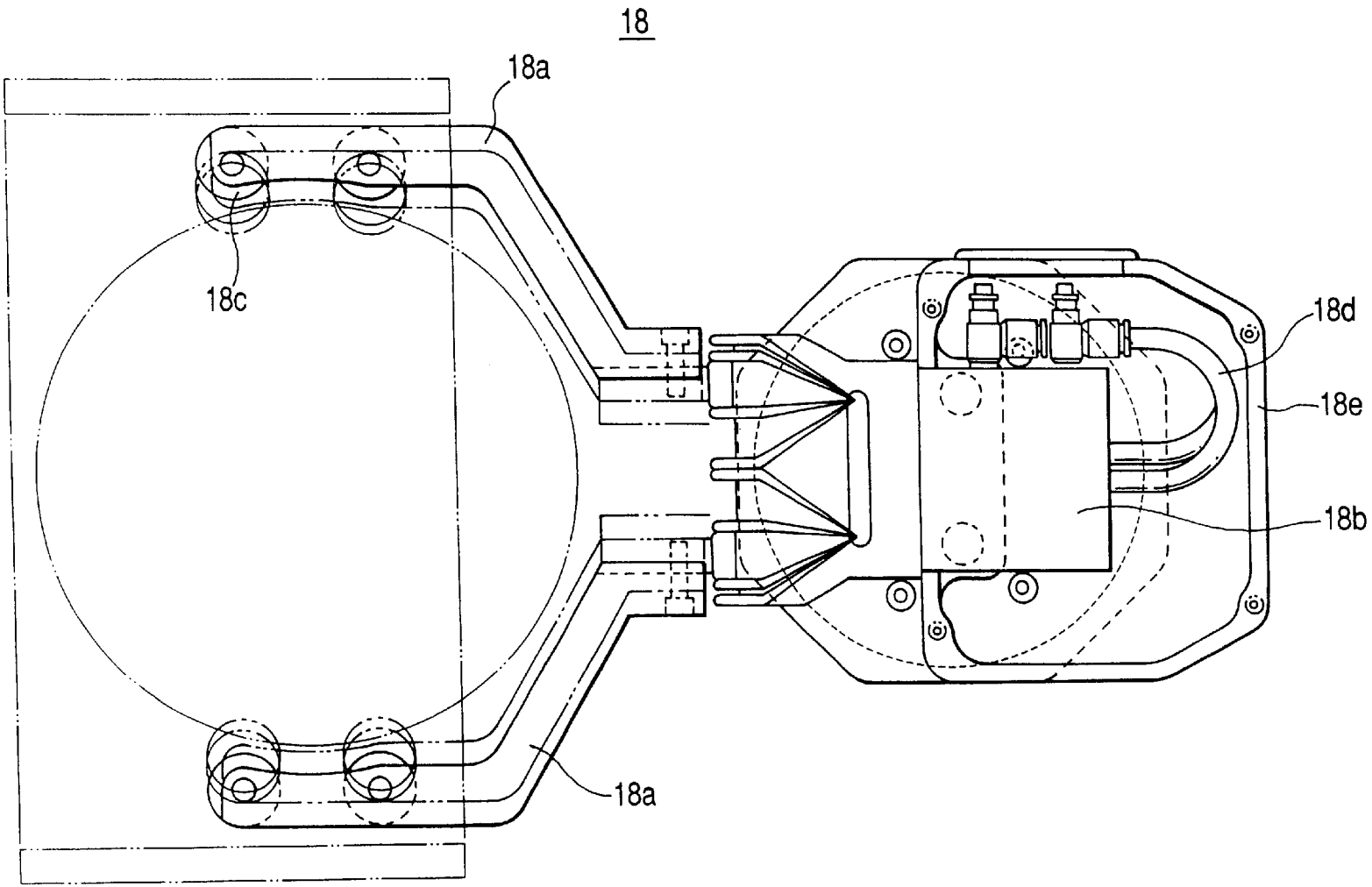
FIG. 9 shows a plane view of a polishing pad transportation robot.
Figure 10:
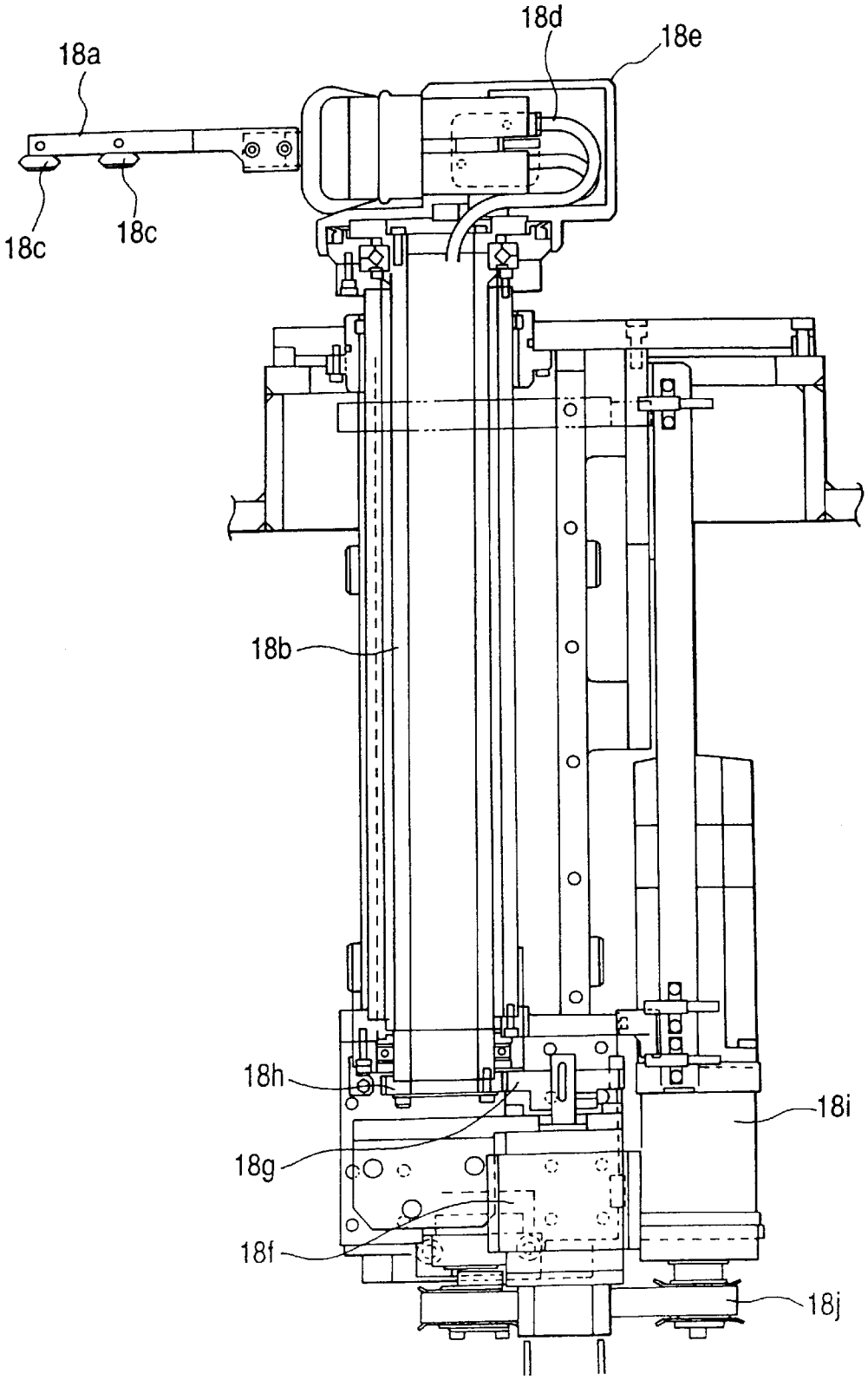
FIG. 10 shows a cross-sectional view of the profile plane of the polishing pad transportation robot.

As FIGS. 9 and 10 indicate, the polishing pad transportation robot (18) possesses cross-roller parallel hands, which have been obtained by attaching the rollers (18*c*) and (18*c*), which can be inserted into and gripped by the outer circumferential annular channels (40*a*) of the polishing pad component attachment panel, to a pair of claws (arms) (18*a*), and the claws of said hands are opened or closed based on air pressure. For this reason, the air hose (18*d*), which is stored within the booth (18*e*), is guided to the hollow rotation axle (18*b*) and then connected to a compressor (not shown in the figures).

The rotation of the rotary actuator (18*f*), furthermore, is received by the gear (18*g*), and is then transmitted to the rotation axle (18*b*) based on this constitution. A ball screw is rotated by the pulley (18*j*), which has received the driving force of the servo motor (18*i*) of the drive source of the (un)lift mechanism, and the rotation axle (18*b*) is (un)lifted upward and downward (Z axis direction) by a shifter attached to said ball screw.

Next, the procedures for exchanging a used polishing pad component (4) with a new polishing pad component (4), which has been prepared on the storage shelf (19), in the CMP device (1) thus constituted will be explained. The polishing pad components are hereby exchanged by implementing the following processes (1) through (12):

(1): The arm (18*a*) of the transportation robot is elevated to a position corresponding to the polishing pad detachment height vis-è-vis the polishing head (2), and the arm (18*a*) is subsequently rotated by 90 along the head direction;

(2): The polishing pad component (4), which is drawn toward the polishing head (2), which is axially supported on the rotation axle (3), which possesses an axial core along the perpendicular direction, based on vacuum suction, is shifted toward the polishing pad transportation robot (18), which is provided along the extension of the shift orbit of the central point of the polishing pad component between left and right (X axis direction), by the shift mechanism (7), and it is stopped at a polishing pad exchange position which is slightly farther away than the pad conditioning mechanism (5);

(3): The claw width of the arm (18*a*) of the transportation robot is contracted by feeding compressed air into the hose (18*d*), and two pairs of rollers (18*c*), (18*c*), (18*c*), and (18*c*), which are attached to said arm, are inserted into the annular channels (40*a*), which have been provided along the outer circumference of the polishing pad attachment panel, in order to grip the polishing pad component (4);

(4): Next, the vacuum suction of the polishing head (2) vis-à-vis the flow path (21) is cancelled, and compressed air is fed into the polishing head (2) from a compressor for facilitating the detachment of the polishing pad component (4) from the polishing head (2);

(5): The arm (18*a*) of the transportation robot is temporarily lowered, and the polishing pad component (4) is detached from the temporary binding components (26); in such a case, the temporary binding components (26) are deformed in accordance with the downward displacement of the arm (18*a*) of the transportation robot due to the springy character of the temporary binding components (26); next, the arm (18*a*) of the transportation robot is rotated by 90 in the opposite direction, and the arm is elevated or lowered to a position corresponding to the height of the platform (19*a*) of the polishing pad storage shelf (19) on which the polishing pad component (4) is to be mounted;

(6): The polishing pad storage shelf (19) is caused to move forward toward the polishing pad transportation robot (18), and the feeding of compressed air into the hose (18*d*) is terminated while the air is depleted; after the polishing pad component has been liberated by expanding the arm claw width of the polishing pad transportation robot (18), the polishing pad component (4) is mounted onto the storage shelf platform (19*a*);

(7): The storage shelf (19) is caused to recede;

(8): The arm (18*a*) of the transportation robot is elevated or lowered to a position corresponding to the height at which a new polishing pad component (4) can be gripped;

(9): The storage shelf is caused to move forward toward the polishing pad transportation robot (18), and the two pairs of rolls attached to the arm are inserted into the annular channels which have been provided on the outer circumference of the new polishing pad attachment panel based on the contraction of the claw width of the transportation robot in order to grip the polishing device;

(10): The storage shelf (19) is caused to recede;

(11): The arm of the transportation robot is rotated by 90 along the direction of the polishing head (2), and the polishing pad component (4) is subsequently drawn toward the polishing head (2) based on the vacuum suction of the flow path (21) of said head;

(12): The claw width of the transportation robot is expanded for inducing the shift of the rotation axle (3) between left and right away from the polishing pad transportation robot (18);

(13): When the prevailing polishing pad component becomes worn and where said polishing pad component must be exchanged with a new polishing pad component, the aforementioned processes of (2) through (12) are repeated.

The aforementioned embodiment of the CMP device represents merely one example, and accordingly, various modified examples are within the scope of the present invention. The wafer loading zone S1, rough polish zone S2, finish processing zone S3, and the wafer unloading zone S4 may, for example, be designated as index table processing zones, or the wafer (un)loading [zone] S1, rough polish zone S2, and the finish polish zone S3 may instead be designated as such index table processing zones while the index table is rotated by a 120 increment. The wafer loading and unloading zone S1, wafer rear plane rough polish zone S2, wafer rear plane finish polish zone S3, and the wafer polish zone S4 may, for example, be designated as said index table processing zones while the polishing device exchange device of the present invention is assigned to the head to which the polishing pad component which passes the polish zone S4 is drawn based on vacuum suction.

Figure 11:
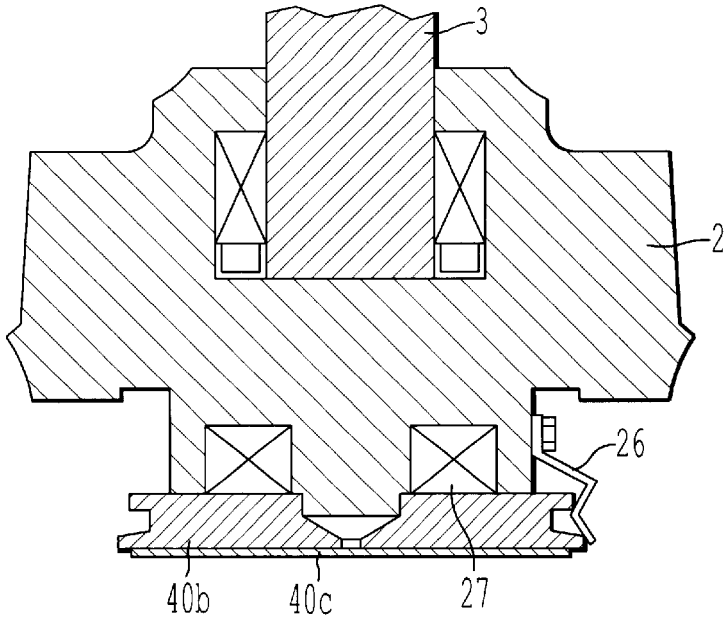
FIG. 11 shows a cross-sectional view of the polishing head and the polishing pad component which has been attached to it in a detachable fashion based on electromagnetic suction in the CMP device of the present invention.

The aforementioned example, furthermore, shows a case where the polishing pad component (4) is fixed to and retained by the lower end of the polishing head (2) based on vacuum suction (i.e., [reiterated]), but it is also possible to rely on a fixation method which utilizes a magnetic force or a fixation method which uses a gadget. In a concrete embodiment, the attachment panel (40*b*) that constitutes the polishing pad component (4) may, for example, be formed by a material which can be drawn to a magnet while the electromagnet (27) is provided at the lower end of the polishing head (2) in such a way that the polishing head (2) can be retained by said electromagnet (27) in a detachable fashion, as FIG. 11 indicates (magnetic fixation method), and it is also possible to rely on a method wherein the polishing pad component (4) is mechanically retained by the lower end of the polishing head (2) via a clamp mechanism or bolt, etc. in a detachable fashion (mechanical fixation method). The temporary binding components (26) may, furthermore, be substituted with a fixation method which uses a magnetic force.

Figure 14:
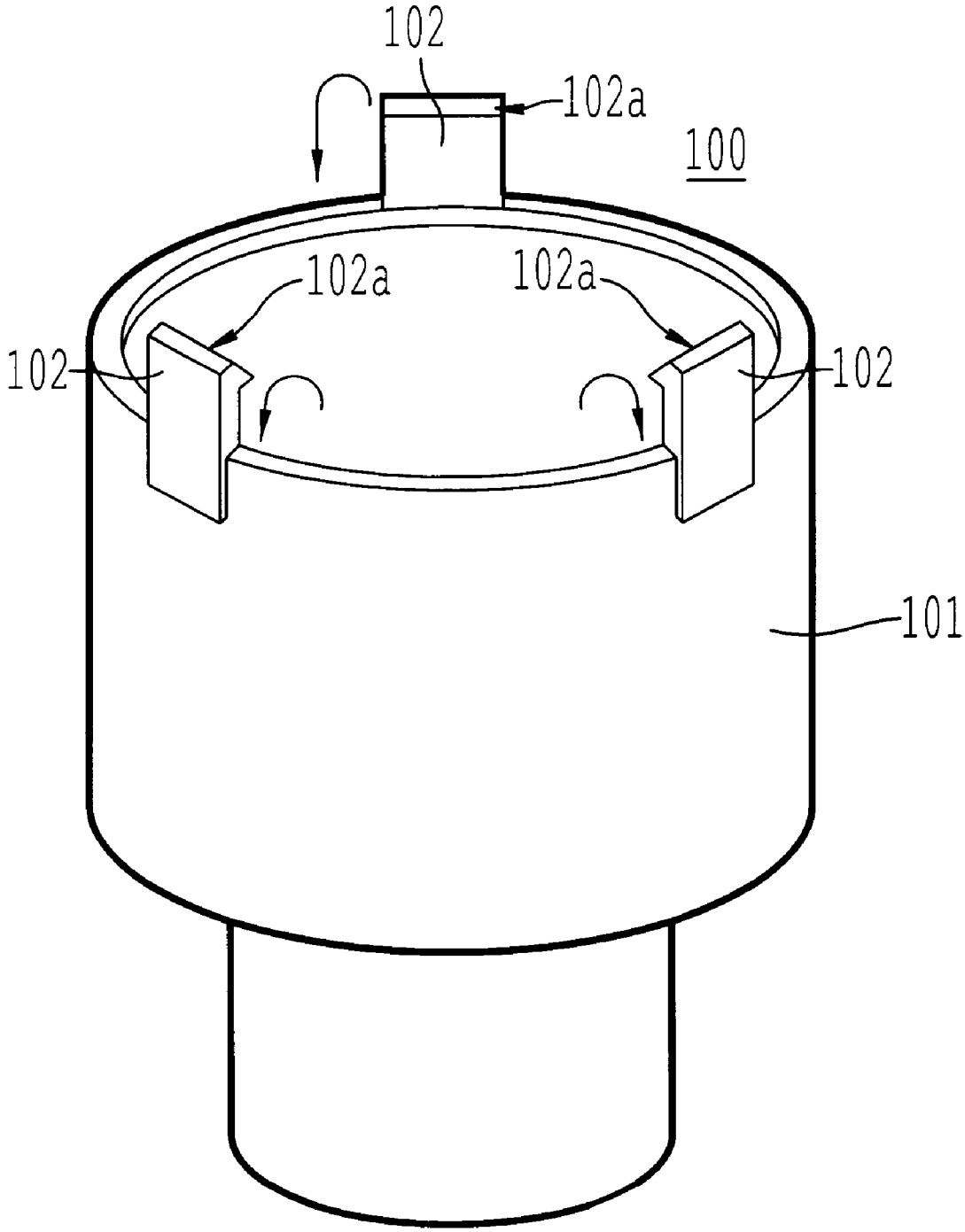
FIG. 14 shows an approximate constitution of a temporary exchange platform which is used for exchanging usable polishing pad components in the CMP device of the present invention.
Figure 15:
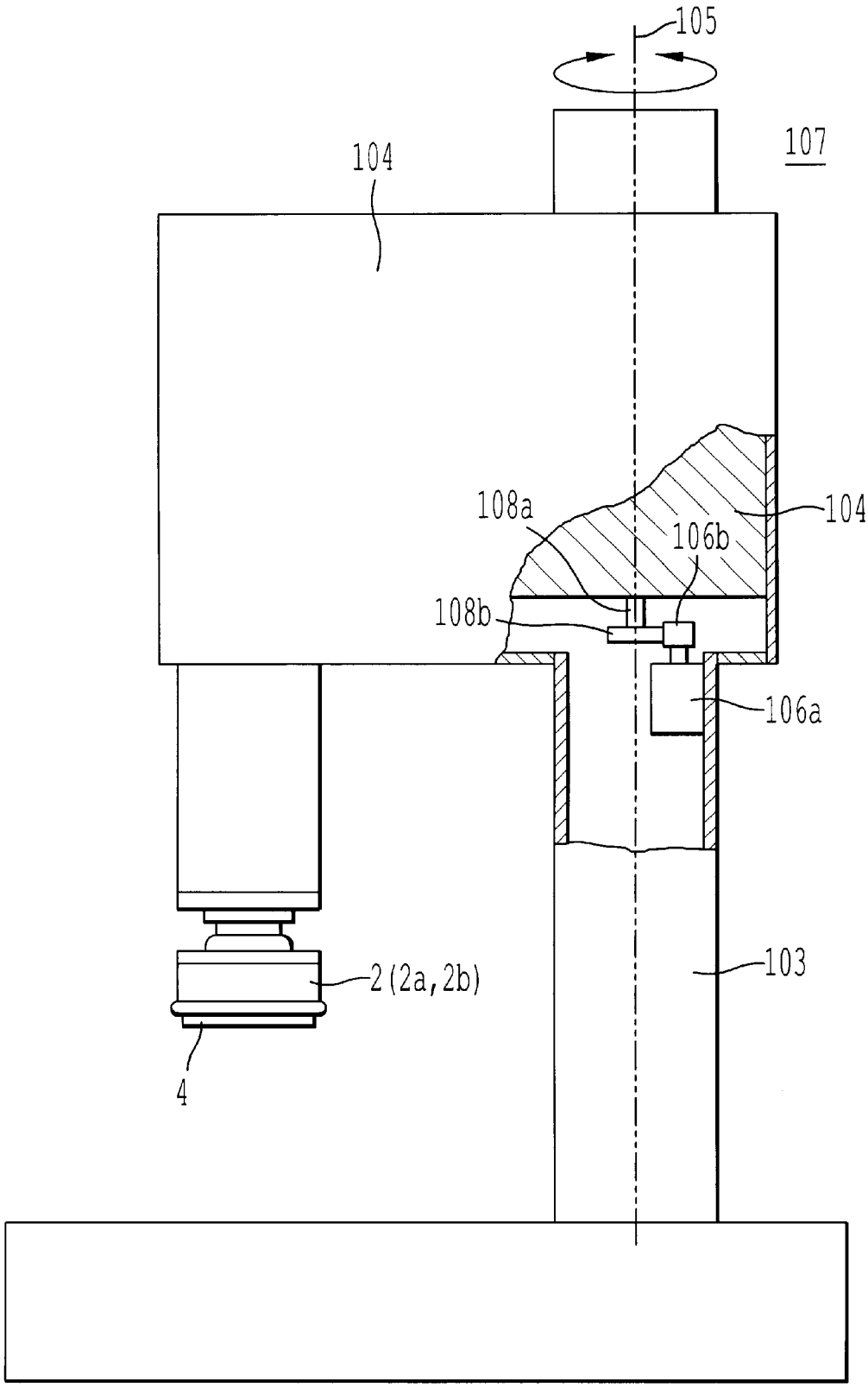
FIG. 15 shows an approximate constitution of a transportation mechanism for the polishing head which can be applied to another embodiment of the CMP device of the present invention.

Incidentally, the CMP device of the present invention is not limited to that of the aforementioned application embodiment. Regarding the CMP device of the aforementioned application embodiment, the polishing head (2) is shifted to the polishing pad exchange position by the shift mechanism (7) during an operation for exchanging the polishing pad component (4), and the polishing pad component (4) is relayed to the polishing pad transportation robot (18) after the force for retaining it has been attenuated. The CMP device of the present invention, however, may be constituted to accommodate an exchanging operation between the polishing head (2) of the polishing pad component (4) and the polishing pad transportation robot (18) via the temporary exchange platform (100) during an operation for exchanging the polishing pad component (4), as FIG. 14 indicates.

This temporary exchange platform (100) includes the temporary exchange platform mainframe (101) having the shape of a cylinder, the diameter of which is slightly larger than that of the polishing pad component (4), and the interlocking claw (102) which has been provided on the outer circumference of the temporary exchange platform mainframe (101). Such interlocking claws (102) are provided at three positions at equal intervals around the axial core of the temporary exchange platform (100). The interlocking claws (102), furthermore, open along the direction of the arrow graphically shown in FIG. 3 as the polishing head (2) or polishing pad transportation robot (18) approaches it. Incidentally, the interlocking claws (102) are constituted to close in the opposite direction of the direction of the arrow when the polishing pad component (4) has been placed on the upper plane of the temporary exchange platform mainframe (101) by the polishing head (2) or where the polishing pad component (4) has been placed on the upper plane of the temporary exchange platform mainframe (101) by the polishing pad transportation robot (18). In such a case, the claws proper (102*a*) of the interlocking claws (102) are interlocked with the annular channels (40*a*) of the polishing pad component (4) in order to prevent the polishing pad component (4) from being removed from the temporary exchange platform (100). Incidentally, a mechanism for driving the interlocking claws (102) is provided within the temporary exchange platform mainframe (101).

The polishing pad components (4) are exchanged according to the procedures shown below while the temporary exchange platform (100) is thus provided at the polishing pad exchange position. Incidentally, only attributes which differ from those of the aforementioned application embodiment will be explained.

When a used polishing head (2) has come to approach the top of the temporary exchange platform (100) by the shift mechanism (7), the interlocking claws (102) are opened based on the aforementioned mechanism, as a result of which the polishing head (2) gradually approaches the upper plane of the temporary exchange platform (100), and when the polishing pad component (4), which is retained by the polishing head (2), has become placed on the upper plane of the temporary exchange platform (100), the force for retaining the polishing pad component (4) becomes attenuated while the interlocking claws (102) are closed. Subsequently, the polishing head (2) is caused to recede from the temporary exchange platform (100), followed by the approach of the polishing pad transportation robot (18). Once the arm (18*a*) of the polishing pad transportation robot (18) has gripped the polishing pad component (4), the interlocking claws (102) are opened, and the polishing pad transportation robot (18) transports the polishing pad component (4) onto the storage shelf (19).

Next, the polishing pad transportation robot (18) transports an unused polishing pad component (4) onto the temporary exchange platform (100). When the polishing pad component (4), which is gripped by the polishing pad transportation robot (18), has been placed on the upper plane of the temporary exchange platform (100), the interlocking claws (102) are closed. When the polishing pad component (4) which has been released from the polishing pad transportation robot (18) has receded to a certain position, the polishing head (2) subsequently approaches the temporary exchange platform (100). The polishing head (2) approaches from above the temporary exchange platform (100), and the interlocking claws (102) are opened as a result of the retention of the polishing pad component (4). Next, the polishing head (2) is transferred onto the index table (12) by the shift mechanism (7).

Incidentally, the shift mechanism (7) is not limited to that of the aforementioned application embodiment. Regarding the aforementioned application embodiment, the polishing head (2) is constituted by the rail (7*a*), feed screw (7*b*), and the motor (7*f*), which drives and rotates said feed screw (7*b*) in the context of displacing the polishing head (2) along the feed direction of the feed screw (7*b*). The shift mechanism (107), on the other hand, is constituted to drive and rotate the polishing head (2) around the central axle (105) of the support pillar (103). This shift mechanism (107) is constituted by the support pillar (103) which is fixed to the CMP device, the ridge (104) which is attached in such a way that it can be rotated around the axial core of the support pillar (103), and the polishing head (2) which is attached to the ridge (104). The motor (106*a*), which serves a function of rotating the ridge (104), the gear (106*b*) which is attached to the motor (106*a*), the axle (108*a*) which is fixed to the ridge (104), and the gear (108*b*) which is provided on the axle (108*a*), furthermore are provided in the interior of the support pillar (103).

This shift mechanism is constituted to transmit the rotational driving force of the motor (106*a*), which is fixed to the support pillar (103), to the ridge (104) via the gear (106*b*) and the gear (108*b*). In such a case, the ridge (104) engages in a rotating motion around the axle (105). The polishing head (2), which is fixed to said ridge (104), therefore engages in a rotating motion as well.

Incidentally, the mechanism for driving and rotating the polishing head (2) and its (un)lift mechanism are identical to those shown in FIG. 4, and therefore, overlapping explanations will be avoided. Incidentally, the rotation axle (3) of the polishing device, motor (3*a*), etc. are mounted in the interior of the ridge (104).

When the shift mechanism (107) is provided, furthermore, a shift mechanism (107) is provided for each polishing head (2). A polish zone, pad conditioning mechanism (5), and the temporary exchange platform (100) for the polishing pad, furthermore, are provided along the circular shift orbit of the polishing head (2). In this way, the polishing head (2) can be positioned at an arbitrary member of the respective mechanisms.

Figure 12A:
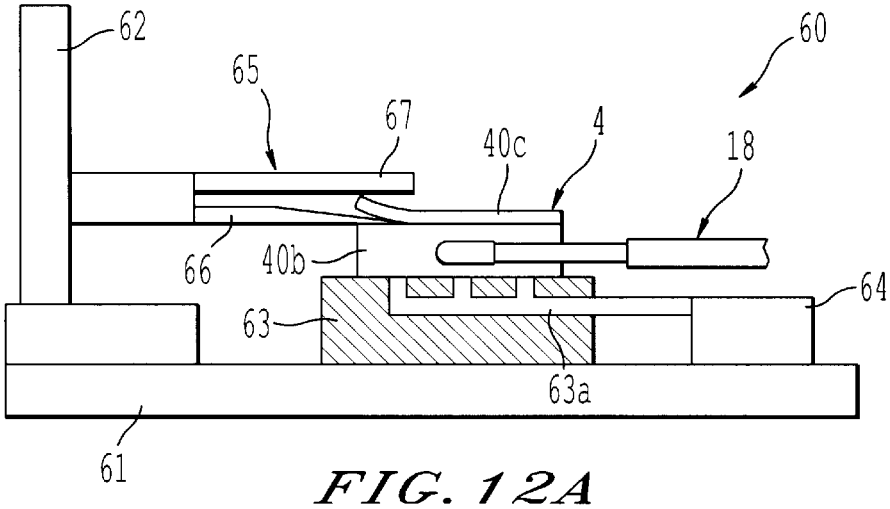
FIG. 12 shows an approximate frontal view of a polisher reloading mechanism which possesses a polisher peeling mechanism.

It is also possible to configure a pad retention mechanism, which enables automatic attachment and detachment of the polishing cloth (40*c*) of the polishing pad component (polisher) to and from the attachment panel (40*b*) (polisher supporter) within the CMP device (1) of the present invention. The corresponding polisher reloading mechanism (60) will be explained with reference to FIGS. 12 and 13. Incidentally, an operation for automatically peeling the used polishing cloth (40*c*) from the used polishing pad component (4) is shown in FIG. 12, whereas an operation for pasting an unused polishing cloth to the attachment panel (40*b*), from which the polishing cloth has been thus peeled, is shown in FIG. 13.

The polisher reloading mechanism (60) has the shift platform (62) attached to the top of the base platform (61) in such a way that it can be freely displaced between left and right in the figure, the polisher peeling mechanism (65), which has been attached to said shift platform (62), and the polisher pasting mechanism (70). Incidentally, the polisher peeling mechanism (65) and polisher pasting mechanism (70) may be collectively detached/attached and exchanged, or the two may be attached to the shift platform (62) at mutually differing attachment angle positions for enabling the selection of either based on the rotation of the shift platform (62). It is also possible to configure a polisher reloading mechanism (60) which possesses a polisher peeling mechanism (65) together with a polisher reloading mechanism (60) which possesses a polisher pasting mechanism (70).

The pad retention component (63) is provided on the base platform (61) for enabling the mounting of the polishing pad component (4) which is transported by the polishing pad transportation robot (18) above the pad retention component (63). The vacuum pump (64), which is connected to the path (63*a*), which has been formed in the interior of the pad retention component (63), is also provided, and the pressure within said path (63*a*) is lowered by the vacuum pump (64) for enabling the fixation and retention of the polishing pad component (4) to and by the top of the pad retention component (63) based on vacuum suction.

Figure 12B:
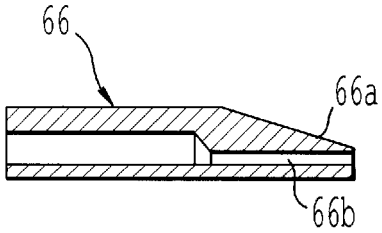
Figure 13:
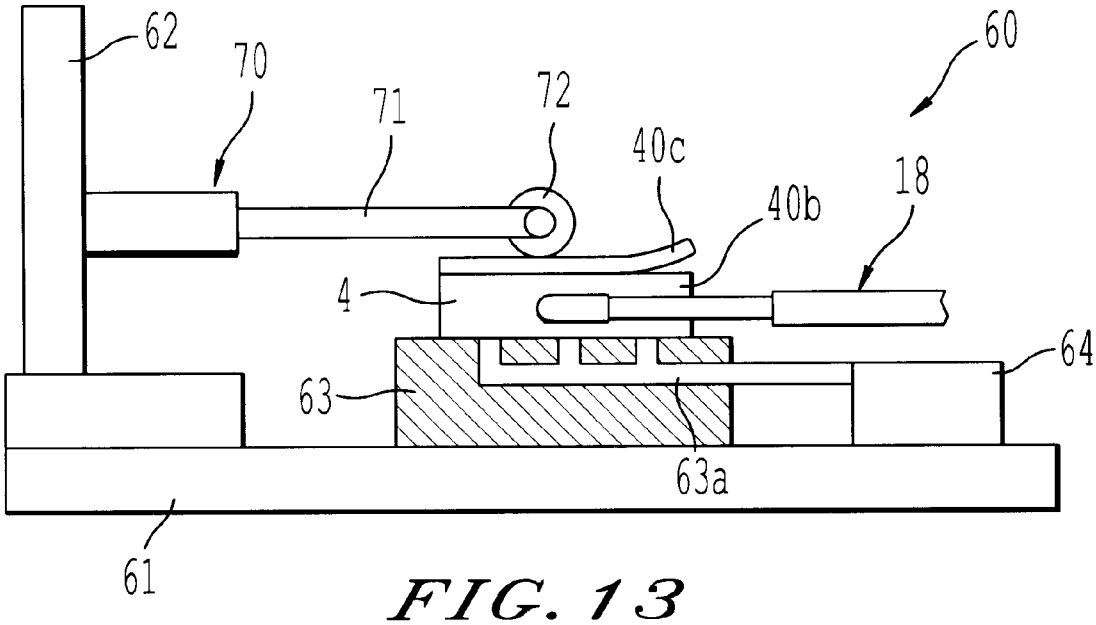
FIG. 13 shows an approximate frontal view of a polisher reloading mechanism which possesses a polisher pasting mechanism.

As FIG. 12(B) indicates, the polisher peeling mechanism (65) is constituted by the peeling arm (66), the front end (66*a*) of which is sharp and on which the micro-void (66*b*), through which a peeling liquid (e.g., alcohol which dissolves an adhesive, etc.) is fed, has been formed, and the inhibitory arm (67), which is positioned above the peeling arm (66). The polisher pasting mechanism (70), on the other hand, is constituted by attaching the roller (72) to the front end of the support arm (71), which has been attached to the shift platform (62), in a freely rotatable fashion in FIG. 13.

An operation for peeling the used polisher (40*c*) from the polishing pad component (4) and for pasting the new polisher (40*c*) onto it by using the polisher reloading mechanism (60), the constitution of which has been described above, will be explained. During this operation, the used polishing pad component (4), which has been detached from the polishing head (2) and then transported by the polishing pad transportation robot (18) according to the aforementioned procedures, is first transported onto the pad retention component (63), where it is fixed and retained based on vacuum suction. Next, the front end of the peeling arm (66) of the polisher peeling mechanism (65) is inserted into the gap between the polisher supporter (40*b*) of the polishing pad component (4) and the polisher (40*c*), and the front end of the peeling arm (66) is caused to penetrate further while a peeling liquid is dispensed through the micro-void (66*b*). Incidentally, an arm which is not shown in the figure is hereby provided for gripping and pulling the front end of the polisher which has been thus peeled and liberated, and the polisher (40*c*) is peeled from its edge based on this pulling action.

After the used polisher (40*c*) has been thus peeled completely, the surface of the polisher supporter (40*b*) is washed and dried, and after an adhesive has been coated on it, the new polisher (40*c*) is mounted on said surface by using a conventionally-known transportation device (not shown in the figure). Next, as FIG. 13 indicates, the polisher (40*c*) is pressed onto the polisher supporter (40*b*) by the roller (72) of the polisher pasting mechanism (70) in order to induce their complete adhesion. Incidentally, the polishing pad component (4), the polisher (40*c*) of which has been thus reloaded, is transported onto the storage shelf (19) by the polishing pad transportation robot (18) in preparation for the next exchange occasion. Not only may this polisher reloading mechanism (60) be used while connected to the CMP device, but it may also be used alone.

In the following, application examples of the polishing pad exchange device of the present invention will be explained.

APPLICATION EXAMPLE 1

A case where a polishing pad component (4) the pad of which has become severely worn as a result of a lengthy ILD polishing operation by using the polishing device explained above will be explained. The CMP polishing device (1) is hereby constituted by using a polishing pad component (4) the diameter of which is smaller than that of the wafer (polishing object) (W). The polishing pad component (4) is constituted by pasting 101000/SUBA400 (polishing pad manufactured by Rodell Co.; diameter: 150 mm) onto a polisher supporter constituted by an alumina substrate. It was then set on the storage shelf (19).

Regarding this application example, an operator opened the door of the polishing device (1) located in the vicinity of its polishing unit and then detached the used polishing pad component (4), which was currently mounted on the polishing head (2). For this reason, the operative device of a rear panel was first operated in order to induce the leak of the negative vacuum pressure which had been responsible for the vacuum suction, as a result of which the suction action of the polishing pad component (4) was turned OFF. It was possible to detach the polishing pad component (4) from the polishing head (2) based on such a manual operation.

Next, a new polishing pad component (4) which had been preliminarily set on the storage shelf (19) was held by a hand and retained in such a way that it would be in contact with the lower end plane of the polishing head (2), and the vacuum suction status was turned ON by operating the operative device of the rear panel, as a result of which the exchange of polishing pad components (4) was completed. When the temporary binding components (26) is hereby used, it becomes unnecessary to hold the polishing pad component (4) to be exchanged with a hand until the commencement of the vacuum suction. Incidentally, the duration of the aforementioned exchange operation was 1 min.

APPLICATION EXAMPLE 2

In this example, too, a pad support method based on vacuum suction was used, and a polishing pad component (4) which had been obtained by attaching 101000/SUBA400 (polishing pad manufactured by Rodell Co.; diameter: 150 mm) onto a polisher supporter constituted by an alumina substrate was set on the polishing pad storage shelf (19) by means of a manual operation by using a CMP polishing device wherein the polishing pad component was smaller than the polishing object.

Next, the automatic exchange button of the front panel of the CMP device was pressed by an operator. As a result, the air cylinder (8) was activated, and after the side of a used polishing pad component (4) which was being drawn toward the polishing head (2) based on vacuum suction had been gripped by the exchange arm, the vacuum suction force which had been responsible for the fixation of the polishing pad component (4) was turned OFF. Next, the exchange arm, which had been gripping the used polishing pad component (4), transported it to the lowermost layer of the storage shelf (19), where it was stored.

Subsequently, the arm gripped an unused polishing pad component (4) which had been set on the upper level and then transported to the lower end of the polishing head (2) in such a way that the polishing pad component (4) would be in contact with it. Subsequently, the vacuum suction operative status was turned ON, and the unused polishing pad component (4) was drawn toward the polishing pad component (4) based on vacuum suction. The exchange operation time thereby elapsed was 30 sec., and there was absolutely no operation performed by a human (operator) in the vicinity of the polishing site.

APPLICATION EXAMPLE 3

A magnetic fixation method was used as a method for fixing a polishing pad component in this example. Regarding this example, the polishing pad component (4) was constituted by pasting 101000/SUBA400 (polishing pad manufactured by Rodell Co.; diameter: 150 mm) onto a polisher supporter constituted by a magnet (SUS410) with a thickness of 0.2 mm, and an unused polishing pad component (4) thus constituted was set on the polishing pad storage shelf (19).

Next, the automatic exchange button of the front panel of the CMP device was pressed by an operator. As a result, the exchange arm gripped the used polishing pad component (4), and subsequently, the electromagnet which had been responsible for the fixation of the polishing pad component (4) was turned OFF. The exchange arm transported the used polishing pad component (4) while still gripping it, which was then stored in the lowermost layer of the storage shelf (19). Subsequently, the unused polishing pad component (4) which had been set on the upper level of the storage shelf (19) was gripped, and the arm was then transported in such a way that the polishing pad component (4) would become in contact with the polishing head (2). Subsequently, the electromagnet was turned ON, and the polishing pad component (4) was fixed. The exchange operation time thereby elapsed was 30 sec., and there was absolutely no operation performed by a human (operator) in the vicinity of the polishing site.

APPLICATION EXAMPLE 4

A gadget fixation method was utilized as a method for fixing the polishing pad component (4) in this example. Regarding this example, the polishing pad component (4) was constituted by pasting 101000/SUBA400 (polishing pad manufactured by Rodell Co.; diameter: 150 mm) onto a polisher supporter constituted by an alumina substrate, and it was used in a CMP polishing device wherein the polishing pad component was smaller than the polishing object. An unused polishing pad component thus constituted was set on the polishing pad storage shelf (19).

Next, the automatic exchange button of the front panel of the CMP device (1) was pressed. As a result, the used polishing pad component (4) was gripped by the exchange arm, and subsequently, a clamp which had been responsible for the fixation of the polishing pad component (4) was automatically detached. The exchange arm gripped the used polishing pad component (4), which was then stored in the lowermost layer of the storage shelf (19). Subsequently, the unused polishing pad component (4) which had been set on the upper level of the storage shelf (19) was gripped, and the arm was transported in such a way that the polishing pad component (4) would become in contact with the polishing head unit. Subsequently, the clamp was automatically tightened, and the polishing pad component (4) was fixed. The exchange operation time thereby elapsed was 30 sec., and there was absolutely no operation performed by a human (operator) in the vicinity of the polishing site.

APPLICATION EXAMPLE 5

The polisher reloading mechanism (60) was provided in the vicinity of the polishing site of the polishing device in this example. Multiple units of 101000/SUBA400 (polishing pad manufactured by Rodell Co.; diameter: 150 mm) were set on this polisher reloading mechanism (60) as polishers. The automatic exchange button of the front panel of the CMP device (1) was then pressed by an operator. As a result, the side portion of the used polishing pad component (4) was gripped by the exchange arm, and subsequently, the vacuum suction force responsible for the fixation of the polishing pad component (4) was turned OFF. The arm gripped the used polishing pad component (4) and then transported it to the polisher reloading mechanism (60).

Upon its arrival at the reloading mechanism (60), the used polishing pad component (4) was transported onto the pad retention component (63), where it was fixed and retained based on vacuum suction by activating the vacuum pump (64). Next, the front end of the peeling arm (66) of the polisher peeling mechanism (65) was inserted into the gap between the polisher supporter **(40*b*) and polisher (40*c*) of the polishing pad component (4), and a peeling liquid was dispensed via the micro-void (66*b*). The front end of the polisher thereby peeled and released was gripped and pulled by an arm (not shown in the figure), as a result of which the polisher (40*c*)** was peeled from its edge.

After the used polisher **(40*c*) had been thus peeled completely, the surface of the polisher supporter (40*b*) was washed and dried, and after an adhesive had been coated on its surface, an unused polisher (40*c*) was mounted and pressed onto said surface by a conventionally-known transportation device. Next, as FIG. 13 indicates, the polisher (40*c*) was pressed onto the polisher supporter (40*b*) sequentially from its edge by using the roller (72) of the polisher pasting mechanism (70)** in such a way that no air would be trapped, and as a result, it was completely adhered.

After the adhesion operation has been thus completed, said polishing pad component (4) was transported to a position adjacent to the lower end plane of the polishing head (2) by the polishing pad transportation robot (18), and subsequently, it was fixed to and retained by the polishing head (2) based on vacuum suction. The exchange operation time thereby elapsed was 2 min., and since an operation for pasting a polisher onto a polisher supporter, which is essentially a manual attachment operation, was completely dispensed with, the operative efficiency vis-à-vis the polishing machine was greatly improved.

Comparative Example

For reference purposes, an exchange operation was carried out in accordance with the abrasion wear of a polishing pad component in a polishing machine endowed with an 800 mm polishing disc. The polishing pad component was fixed to the polisher supporter, and after the polishing machine had been temporarily stopped by an operator, the polisher supporter, which weighed approximately 15 kg, was transported out of the polishing machine. Subsequently, the polishing pad component was gradually peeled off the polisher supporter. Next, an unused pad was attached, and the supporter onto which the polisher had been thus pasted was set in the interior of the polishing machine. During this operation, 5 min. and 20 min. were respectively expended for the transportation of the polisher supporter and the reloading of pads.

As the foregoing explanations have demonstrated, regarding the present invention, a polishing object is retained by an object retention mechanism while its plane to be polished faces upward, and the polishing plane of the polishing pad component which is retained by the pad retention mechanism is pressed onto the plane to be polished from above, whereas the plane to be polished is polished based on the relative shift of the two members (relative rotational shift), and since the polishing pad component is constituted to be automatically attached to and/or detached from the pad retention mechanism by the fixation and retention mechanism for exchange purposes, a used polishing pad component can be automatically exchanged with an unused one, based on which the polishing pad exchange operative efficiency is improved. As a result, the device inoperative period can be reduced to a minimum, and since the operative efficiency of the polishing device can be elevated, the production cost can be reduced. Cumbersome procedures can, furthermore, be eliminated from an actual operation, and the effects of external factors (e.g., dust, etc.) can also be eliminated during a polishing operation.

The mechanism for shifting the pad retention mechanism can, furthermore, be shifted to the exchange position for the polishing pad component, and therefore, no special shift mechanisms are required for exchange purposes.

Incidentally, it is desirable for the polishing pad component to be constituted to be automatically attached to and/or detached from the pad retention mechanism for exchange purposes and for the polishing pad component thus attached and/or detached to be transported by a transportation mechanism. Additional automation benefits can be achieved based on such a constitution, and the exchange operative efficiency can be phenomenally improved.

When the polishing pad component is caused to be fixed to and retained by the pad retention mechanism by the fixation and retention mechanism based on the aforementioned constitution, it is desirable to configure a temporary binding mechanism which temporarily binds the polishing pad component to the pad retention mechanism. In such a case, the polishing pad component can be temporarily bound and supported by the temporary binding mechanism and by the pad retention mechanism, and since the fixation and retention functions of the fixation and retention mechanism can be invoked in this state, the polishing pad component can be easily fixed and retained.

The aforementioned polishing pad component may, for example, be constituted by a polisher which polishes the plane of a polishing object to be polished while in contact with it and a polisher supporter which retains said polisher planewise. In such a case, the polishing device can be easily renewed by simply peeling the polisher from the polisher supporter of a used polishing pad component which has been detached from the pad retention mechanism and then pasting an unused polisher onto it.

Incidentally, the fixation and retention mechanism may be constituted in such a way that the polishing pad component will be fixed to and retained by the lower end of the pad retention mechanism based on vacuum suction. It is also possible, furthermore, for a polishing pad component to be constituted by a polisher and a polisher supporter made of a magnet, whereas the fixation and retention mechanism may be constituted in such a way that the polishing pad component will be fixed to and retained by the lower end of the pad retention mechanism based on a magnetic force. The polishing pad component may, furthermore, be fixed to and retained by the lower end of the pad retention mechanism via a fixation gadget (e.g., clamp mechanism, bolt stopper mechanism, etc.). Polishing pad components can be automatically exchanged with ease based on any of these constitutions.

The polishing device explained above may also be endowed with a storage shelf on which a polishing pad component which has been attached to and/or detached from the pad retention mechanism for exchange purposes is stored after having been transported by a transportation mechanism. In such a case, the exchange operative efficiency can be further improved by storing a multiple number of exchange-ready polishing pad components stocked on the storage shelf.

The aforementioned polishing device may also possess a polisher reloading mechanism which automatically peels the polisher off the polisher supporter of a used polishing pad component which has been detached from the pad retention mechanism for exchange purposes and which automatically pastes an unused polisher onto said polisher supporter. The operation for exchanging polishing pad components can be carried out more efficiently by thus reloading polishers automatically.

What we claim is:

1. A polishing device comprising:

an object retention mechanism adapted to retain an object to be polished such that a plane thereof to be polished faces upward;

a polishing pad component having a polishing plane adapted to polish the plane to be polished while in contact with the plane to be polished;

a polishing head configured to retain said polishing pad component on a lower end thereof such that the polishing plane thereof faces downward, and to impart rotational motion about an axis to said polishing head;

a shift mechanism configured and adapted to cause a relative displacement of said polishing head in relation to said plane to be polished, a pad fixation and retention mechanism adapted to detachably fix and retain said polishing pad component on the lower end of said polishing head such that the polishing plane faces downward, said pad fixation and retention mechanism being provided at the lower end of said polishing head, wherein said shift mechanism is constructed and adapted to displace said polishing head from a polishing position of said plane to be polished to an exchange position of said polishing pad component in a direction different from said rotational axis; and a temporary binding mechanism configured and adapted to temporarily bind said polishing pad component to said polishing head when said pad fixation and retention mechanism is inoperative.

2. A polishing device comprising:

an object retention mechanism adapted to retain an object such that a plane thereof to be polished faces upward;

a polishing pad component having a polishing plane adapted to polish the plane to be polished while in contact with the plane to be polished;

a polishing head configured to retain said polishing pad component on a lower end thereof such that the polishing plane thereof faces downward, and to impart rotational motion about an axis to said polishing head;

a shift mechanism configured and adapted to cause a relative displacement of said polishing head in relation to said plane to be polished;

a transportation mechanism configured and adapted to exchange said polishing pad component while said polishing pad component is transported in relation to said polishing head;

a pad fixation and retention mechanism adapted to detachably fix and retain said polishing pad component on the lower end of said polishing head such that the polishing plane faces downward, said pad fixation and retention mechanism being provided at the lower end of said polishing head, wherein said shift mechanism is constructed and adapted to displace said polishing head from a polishing position of said plane to be polished to an exchange position of said polishing pad component in a direction different from said rotational axis.

3. The polishing device specified in claim 2 wherein said transportation mechanism includes an arm component which is capable of gripping said polishing pad component, and wherein said polishing pad component is constituted to be transported by said transportation mechanism.

4. A polishing device comprising:

an object retention mechanism adapted to retain an object to be polished such that a plane thereof to be polished faces upward;

a polishing pad component having a polishing plane adapted to polish the plane to be polished while in contact with the plane to be polished;

a polishing head configured to retain said polishing pad component on a lower end thereof such that the polishing plane thereof faces downward, and to impart rotational motion about an axis to said polishing head;

a shift mechanism configured and adapted to cause a relative displacement of said polishing head in relation to said plane to be polished, a pad fixation and retention mechanism adapted to detachably fix and retain said polishing pad component on the lower end of said polishing head such that the polishing plane faces downward, said pad fixation and retention mechanism being provided at the lower end of said polishing head, wherein said shift mechanism is constructed and adapted to displace said polishing head from a polishing position of said plane to be polished to an exchange position of said polishing pad component in a direction different from said rotational axis; and a transportation mechanism configured and adapted to transport said polishing pad component for fixation to said polishing head.

5. The polishing device specified in claim 2, further comprising a temporary binding mechanism configured and adapted to temporarily bind said polishing pad component to said polishing head when said fixation and retention mechanism is inoperative.

6. The polishing device specified in claim 1 wherein said polishing pad component comprises a polisher which polishes said plane of said object to be polished while in contact with said object, and a polisher support member which supports said polisher so that said polisher may be planar, wherein said polishing head retains said polisher support member.

7. The polishing device specified in claim 2 wherein said polishing pad component comprises a polisher which polishes said plane of said object to be polished while in contact with said object, and a polisher support member which supports said polisher so that said polisher may be planar, wherein said polishing head retains said polisher support member.

8. The polishing device specified in claim 1 wherein said fixation and retention mechanism is adapted to cause fixation and retention of said polishing pad component to and by a lower end of said polishing head due to vacuum suction of said fixation and retention mechanism.

9. The polishing device specified in claim 2 wherein said fixation and retention mechanism is adapted to cause fixation and retention of said polishing pad component to and by a lower end of said polishing head due to vacuum suction of said fixation and retention mechanism.

10. The polishing device specified in claim 1 wherein said polishing head comprises a magnet and wherein said fixation and retention mechanism is adapted to cause fixation and retention of said polishing pad component to and by a lower end of said polishing head by a magnetic force.

11. The polishing device specified in claim 2 wherein said polishing head comprises a magnet and wherein said fixation and retention mechanism is adapted to cause fixation and retention of said polishing pad component to and by a lower end of said polishing head by a magnetic force.

12. The polishing device specified in claim 1 wherein said fixation and retention mechanism is adapted to cause fixation and retention of said polishing pad component to and by a lower end of said polishing head via mechanical fixation.

13. The polishing device specified in claim 2 wherein said fixation and retention mechanism is adapted to cause fixation and retention of said polishing pad component to and by a lower end of said polishing head via mechanical fixation.

14. The polishing device specified in claim 2, further comprising a storage shelf adapted to store said polishing pad component being exchanged while attached to or detached from said polishing head, after said polishing pad component has been transported by said transportation mechanism.

15. The polishing device specified in claim 6, further comprising a polisher reloading mechanism which automatically peels said polisher from said polisher support member and which automatically pastes a new polisher onto said polishing pad component which has been detached from said polishing head.

16. The polishing device specified in claim 7, further comprising a polisher reloading mechanism which automatically peels said polisher from said polisher support member and which automatically pastes a new polisher onto said polishing pad component which has been detached from said polishing head.

17. The polishing device specified in claim 16 wherein said transportation mechanism is further adapted to transport said polishing pad component, the polisher of which has been reloaded by said poliseher reloading mechanism, onto a storage shelf.

18. A polishing pad component exchange method wherein a polishing pad component on a polishing head is exchanged using the polishing device specified in claim 1.

19. A polishing pad component exchange method wherein a polishing pad component on a polishing head is exchanged using the polishing device specified in claim 2.

20. A device for exchanging a polishing pad component having a polisher pasted thereto, the polishing pad component having an annular channel on an outer circumference thereof, the polishing pad component further having an interlocking unit on a rear plane thereof, comprising:

a polishing head which is axially supported on a spindle axle which is adapted to draw the polishing pad component based on vacuum suction, a lift mechanism adapted to selectively lift and lower said spindle axle, a shift mechanism adapted to provide reciprocal displacements of said spindle axle to an exchange position for said polishing pad component, and a transportation robot which is provided along an extension of a shift orbit of said polishing pad component, the transportation robot being adapted to detach the polishing pad component from the polishing head via an arm, being adapted to position the polishing pad component relative to a storage shelf, and being adapted to cause the polishing pad component to be positioned on the polishing head, wherein a rotation axis of said transportation robot is spaced from said storage shelf.

* * * * *